US008157520B2

(12) United States Patent
Kolacny et al.

(10) Patent No.: US 8,157,520 B2
(45) Date of Patent: Apr. 17, 2012

(54) FAN, AIRFOIL AND VEHICLE PROPULSION SYSTEMS

(76) Inventors: Gordon S. Kolacny, Loveland, CO (US); Bruce A. Kolacny, Loveland, CO (US)

( * ) Notice: Subject to any disclaimer, the term of this patent is extended or adjusted under 35 U.S.C. 154(b) by 963 days.

(21) Appl. No.: 12/316,552

(22) Filed: Dec. 12, 2008

(65) Prior Publication Data

US 2010/0150714 A1 Jun. 17, 2010

(51) Int. Cl.
*F03B 1/00* (2006.01)
*F03B 3/04* (2006.01)

(52) U.S. Cl. ..... 415/224; 415/53.1; 415/53.3; 180/117; 180/122

(58) Field of Classification Search ..... 415/115, 415/224, 53.1, 53.3; 180/117, 122
See application file for complete search history.

(56) References Cited

U.S. PATENT DOCUMENTS

| | | | | |
|---|---|---|---|---|
| 3,460,647 | A | 8/1969 | Laing | |
| 3,877,542 | A | 4/1975 | Paoli | |
| 5,042,605 | A * | 8/1991 | Moriwake | 180/117 |
| 5,072,894 | A * | 12/1991 | Cichy | 244/91 |
| 5,267,626 | A * | 12/1993 | Tanfield, Jr. | 180/117 |
| 5,636,702 | A | 6/1997 | Kolacny | |
| 6,261,051 | B1 * | 7/2001 | Kolacny | 415/53.3 |

* cited by examiner

*Primary Examiner* — David Nhu

(74) *Attorney, Agent, or Firm* — Craig R. Miles; CR Miles, P.C.

(57) ABSTRACT

Vehicle propulsion systems and methods of propulsion are disclosed, as well as embodiments of fans and airfoils, technology that in some applications of the invention can provide both lift and thrust, and propulsion via cross flow fan, manifold and a plurality of airfoils. In some embodiments the invention is directed to the production of lift and thrust, and propulsion generally, based from air produced by a cross flow fan in accordance with the invention disclosed herein. In still further embodiments, lift and thrust may yet be generated from air produced from the cross flow fan even when unpowered, such as in a loss of power or in a stall condition. Applications of the invention apply broadly to propulsion systems, generally; however, some preferred embodiments have particular application for vehicles characterized or used in application such as traditional private and commercial aircraft, ground effects vehicles, military applications, amphibious applications, aerospace, aeronautical, and non-traditional vehicles such as experimental air planes, space craft, hover craft, and the like. The invention in some embodiments comprises technologies addressing preferred air flow, lift, and thrust and the reduction of drag and circulation losses. The invention may be further applicable for incorporation in aircraft and other vehicles wherein the ability to maximize initial vertical lift and takeoff is important, such as in instant take-off and landing, as well as the abilities to hover, to control the flight and landing of aircraft, and control in power-loss scenarios, addressing the prevention of stalls and allowing for controlled descents under continued propulsion. In some embodiments, the invention is further applicable for aircraft, shuttles and other vehicles as a ram jet engine system as a further alternative propulsion technology, having no requirement for forward movement for propulsion upon take-off.

36 Claims, 21 Drawing Sheets

FAN, AIRFOIL AND VEHICLE PROPULSION SYSTEMS

The invention is directed to air flow technologies in tangential and cross flow fan systems, as well as to airfoil technologies for aeronautic and ground-effects applications, among others. The invention in some embodiments comprises technologies addressing preferred air flow, lift, and thrust, as well as propulsion generally, and the reduction of drag and circulation losses. The invention is applicable to aeronautic applications and ground-effects type vehicle design and operation, such as traditional private and commercial aircraft, as well as military and aerospace applications for aircraft, shuttles, and other vehicles, as well as primarily surface-based vehicles such as amphibious vehicles and hovercraft. The invention is further applicable for incorporation in aircraft and other vehicles wherein the ability to maximize initial vertical lift and takeoff is important, such as in instant take-off and landing, as well as the abilities to hover, to control the flight and landing of aircraft, and control in power-loss scenarios, addressing the prevention of stalls and allowing for controlled descents under continued propulsion. In some embodiments, the invention is further applicable for aircraft, shuttles and other vehicles as a ram jet engine system as a further alternative propulsion technology having no requirement for forward movement for propulsion upon take-off.

BACKGROUND OF THE INVENTION

Traditional technologies and designs for airfoil air flow design and lift are well known in aeronautical industries, particularly applied in the implementation of wing structures for airplanes and other vehicles, propellers and for ground-effect vehicles. Jet and propeller propulsion and traditional wing technologies, relating to commercial and private airplanes, military and space applications, have historically dominated the aeronautical industries and markets in traditional airfoil design for air travel, transport and combat. Ground-effects type vehicles, such as amphibious air driven technologies and hover craft, as well as vertical take-off and landing vehicles, may have had historically limited development and success due to the previous complexity of traditional aeronautical theory and its potential inaccuracies.

A conventional and traditionally accepted basis for flight is the acceptance that the preferred means to create lift for an airplane is to utilize conventional airfoil designs based upon presumptions from Bernoulli's principle for evaluating air flow. This basis for flight and airfoil design has been characterized by some as the "Aeronautical Engineering Blunders of the 20$^{th}$ Century". Some have developed a critique of the traditional basis for flight and airfoil design as exemplified and described on the website http://www.aeronautics.ws (found at www.aeronautics.com April 2008) (Gent, G.), the disclosure of which is hereby expressly incorporated by reference. It has also been propositioned that the use of more fundamental principles of physics, such as Newton's Laws of Motion, better define aeronautic principles for flight development, and specifically, airfoil air flow design and lift.

It is with the traditional design of airfoils for aircraft and how the airfoil is traditionally incorporated for flight that commonly known problems associated with traditional aircraft are raised. One such identified problem is the common misunderstanding of how an airfoil produces lift. One such popular but misguided theory of airfoil flow may be the principle of equal transit time of flow above and below wing. The principle may assume that flow over the curved upper portion of a traditional wing occurs in the same time as flow over a more flat lower portion of the wing. Utilizing Bernoulli's law, the greater velocity above the wing would require the upper surface pressure to be less than the lower surface pressure, and hence lift.

One traditional theory that may be advanced by aerodynamic teaching, and in light of the above-described theory, is that actual differences in velocity between above-wing and below-wing air flows may be attributable to "circulation", turbulent air flows caused by pressure differentials, rather than air flows having equal transit time above and below wing with a potentially more preferred laminar flow. This theory may be conceptualized as circulatory movement or flow is superimposed on passing flow, such that the flow over an airfoil is considered flow with circulation. It may then be determined that the rate of interception of circulation in upward momentum, plus the rate of production of downward momentum in recurvature of flow downward, may be considered to equal net lift. Furthermore, induced drag may be a factor wherein rearward thrust of circulation may be greater than forward thrust. Other circulation flows and drag may be considered in traditional attempts to optimize lift and thrust for airfoils embodied as fixed wings of an aircraft. In respect to this traditional theory, losses in lift may be due in part to upward circulation around the wing ends. This loss which may be considered "lateral loss" in some theories reduces upward momentum and relieves pressure differentials that are required for lift.

Under these and other traditional theories the identified need is to reduce factors that ultimately reduce net lift or efficiency of the wing. Recognized and yet heretofore inadequately addressed needs for achieving more adequate lift may have been previously understood as addressed by: increased wing area, increased flow velocity, and increased coefficient of lift.

Some studies have found, however, that the airfoil commonly referred to as an accelerating or acceleration airfoil outperforms conventional airfoils by an increase in flow velocities and pressure differentials for lift. The accelerating airfoil studied in the Gent reference incorporated in this disclosure and cited above found a greater angle of attack in combination with airfoil shape produced limited drag with preferred lift over drag factors. The curving profile along the bottom of the airfoil in the Gent reference appears to be developed for the airfoil tested such that the distance top and bottom from the stagnation point of the leading edge to the trailing edge was the same. In so developing an accelerating airfoil, equal negative pressures were recorded at all angles of attack, top and bottom, creating lift when under traditional Bernoulli-type theories no lift should have been generated.

In the continuing efforts to better understand the benefits of accelerating airfoils, the ongoing desire is to reduce drag and other factors that reduce lift by presenting high velocity air and delivering the air to a preferred design of airfoil to generate the lift. Accordingly, the thought is that the combination of air speed and lift factor results in the actual lift. Heretofore, these concepts have been addressed primarily by single wing aircraft.

However, in one fan-based technology, as found in U.S. Pat. No. 6,261,051 issued to Kolacny, hereby expressly incorporated by reference, a tangential fan and duct are disclosed utilizing fan blades creating a preferred internal ratio of the fan and configured having preferred inner surface curvatures of fan blade airfoils. The technology addresses preferred low and high pressure zones within the tangential fan and the duct as well as preferred laminar flow through the system. The fan blades are configured preferentially to allow for maximized flow with respect to the fan, intake duct and exhaust flow and to improve upon the relationship between the exhaust flow velocity and fan blade tip speed, wherein the fan blade tip speed may be minimized for the greatest amount of exhaust flow velocity.

The '051 patent technology might be thought to be a development of alternative air flow generation independent of traditional technologies that provided assisted air flow. On the other hand, other technologies providing air flow, and propulsion generally, are typically found in common jet engine systems. However, in order to achieve thrust and lift in traditional aircraft, jet engines are typically utilized in order to create a velocity difference between the air entering the ram jet body and the air exiting the system. The air flow may be introduced by traditional axial fans, such as in a turbine jet. The velocity difference between the entrance and exit air is traditionally accomplished by the addition of heat to that portion of the airstream flowing through the ram jet body. Burning liquid fuel inside the ram jet body is one known method of adding heat to a ducted airstream.

Other aircraft have been developed that had taken then untraditional approaches to accomplishing preferred lift with traditional jet engine technology. In some circumstances, the additional complexity was to design an aircraft that could generate on its own enough initial lift to allow the aircraft to take off at a non-moving initial position and even to provide some aspects of hovering while in flight or from the take off. One such aircraft is commonly referred to as the Harrier Jet.

A simplified explanation of the Harrier design is that two jet engines are configured on each side of the air craft and each incorporate an adjustable port to direct thrust of each engine downward to achieve lift for standing take off or to hover. This technology has been pursued initially by British military and other military interests generally for military aircraft application.

The Harrier Jet technology is relatively expensive and may be difficult to maintain, while another primary deterrent is the apparent lack of precise control desirable for certain applications, such as preferred three-dimensional flight control and low or even no flight speed control. In one example, a potential downside is the lack of provision for a stall or loss of power in which the pilot would have very little option in attempting to land the plane without power to provide thrust and lift for a safe landing. Furthermore, the Harrier design may not take advantage of more preferable airfoil designs and configurations that would result in greater lift and thrust, in take off, flight, and landing, particularly as a winged and jet engine driven aircraft. Additionally the Harrier Jet design incorporates technology and resultant thrust effects that may be undesirable with respect to the location of takeoff and landing of the jet, such as over surfaces that are detrimentally affected by the weight of the aircraft generally and the downward thrust of secondary jet engines to achieve lift.

A second and previously developed alternative design is the Osprey design, a design considered by some to be a medium-lift, tilt-rotor aircraft developed by Boeing and Bell Helicopters. A simplified explanation of the Osprey design is that two tilt-rotors on each wing are configured to provide lift, as may be comparable to a helicopter, when taking off or landing vertically. The rotators or nacelles rotate 90 degrees forward once airborne, converting the aircraft into a turboprop aircraft. The technology is relatively expensive, while another primary deterrent is the apparent lack of precise control desirable for certain applications, such as preferred three-dimensional flight control and low or even no flight speed control. The problems and deterrents may have been reflected in the number of setbacks the military and developers had in producing serviceable aircraft. Again, a further potential downside is the lack of provision for a stall or loss of power in which the pilot would have very little options in attempting to land the plane without power to provide thrust and lift for a safe landing. Furthermore, the Osprey may not take advantage of more preferable airfoil designs and configurations that would result in greater lift and thrust, both in take off, in flight, and in landing, particularly as a winged and propeller driven aircraft.

Other alternative designs have been considered for vehicles generally, incorporating some aspects of air flow for creating lift of the vehicle from the ground surface based upon the ground effects created by downward-directed airflow. Some of these designs may be considered amphibious in application, and may include the commonly known swamp boat design that generates thrust from the propulsion created by a rearward axially driven fan. Others may have only been conceived in the theoretical or in fictional works in applications for hover vehicles. Craft that have actually been produced in real world application are designs commonly referred to as hover craft and typically lack preferred control over thrust and lift in order to achieve propulsion, much less precise control desirable for certain applications such as preferred three-dimensional flight control and low or even no flight speed control. Some of these designs may not address control over production of thrust in combination with lift in order to propel the vehicle forward or to lift the vehicle from ground surface. Others may address thrust by alternative means similar to the swamp boat by way of an external and fixed rearward axial fan. Some of these previous attempts are disclosed in U.S. Pat. Nos. 3,877,542, 4,747,459, and 3,460.647.

While many of these drawbacks and inadequacies in the prior art are known and documented, no heretofore developed technology has adequately addressed these needs, and the traditional technologies described above do not bridge the gap or fully achieve preferred control over lift and thrust for propulsion, or to do so for standing take off, to hover, and in takeoff, flight, landing and loss of power scenarios for aircraft.

Heretofore those in the industry may not have considered the possibility of other propulsion possibilities, and the provision for control of the generation of combinations of thrust and lift from air flow providing propulsion in order to achieve not only vertical lift for take-off and for flight, but to achieve preferred flight control from air propulsion such as preferred three-dimensional flight control and low or even no flight speed control. Heretofore generating a controlled combination of thrust and lift for precise and controlled flight and landing in the absence of power supplied to the propulsion system has not been adequately addressed or achieved in traditional designs. Furthermore, it may have even been thought as a recognized drawback in aeronautic and ground-effect systems to incorporate the provision for controlled thrust and lift to accommodate not only lift but as also the source for thrust in forward travel or flight. It may have also been heretofore thought that airfoil design could not be achieved that would provide the necessary lift for real world applications of vehicle dimensions and weight, particularly for any airfoil design beyond traditional single wing aircraft. Additionally, recognized needs for the necessary air flow velocity and coefficiency of lift, as well as what might have been thought of as the requirements for larger airfoil area, may have led aeronautics and ground effects industries to other types of propulsion thought as being singularly capable of producing the necessary thrust and lift apart from airfoil design and jet engine propulsion generally. This may be particularly true wherein the incorporation of air propulsion in combination with jet propulsion has only remained in the development stages as evidenced by shortcomings of the Osprey design.

In addition to all of the deficiencies previously described, the prior art may suffer from one or more of the following deficiencies. The prior art may require further and additional thrust and lifting systems and separate and additional power generation for the propulsion system to achieve a desired result, such as in the take-off and flight of traditional aircraft or in the lack of provision for propulsion in the event of power loss during flight. The prior art may not even provide for the combination of control of thrust and lift, such as preferred three-dimensional flight control and low or even no flight speed control, and for the full propulsion of a vehicle such as an aircraft or ground-effects vehicle. The prior art may even lack the preferred understanding of airfoil design and implementation into a propulsion system, potentially only directed to lift by air flow.

The present invention seeks to overcome one or more of these and other deficiencies of the prior art.

SUMMARY OF THE INVENTION

Vehicle propulsion systems and methods of propulsion are disclosed, as well as embodiments of fans and airfoils, technology that in some applications of the invention provide lift, thrust, and propulsion. In some embodiments the invention is directed to the production of lift, thrust, and propulsion produced from air flow in accordance with the invention disclosed herein. In some preferred embodiments a cross flow fan produces air flow. In still further embodiments, lift and thrust may yet be generated from air produced even when unpowered, such as in a loss of power to the fan, as by one example in a stall condition. Applications of the invention apply broadly to propulsion systems, generally; however, some preferred embodiments have particular application for vehicles characterized or used in application such as ground effects vehicles, military applications, amphibious applications, aerospace, aeronautical, and traditional and non-traditional vehicles such as traditional and experimental air planes, space craft, hover craft, and the like. Further applications apply generally to preferred multi-dimensional flight control and low or even no flight speed control.

The invention is scalable to accommodate preferred lift and thrust. In some embodiments, the invention has a scalable cross flow fan, as well as other scalable features, that produce lift and thrust corresponding to determined lift and thrust requirements. Whereas some traditional systems may be understood as one-dimensional in flight control, limiting its application and generally producing only thrust, and lift only after significant thrust and linear horizontal or vertical movement is obtained, the present invention, incorporating a modified cross flow fan configuration in preferred embodiments, provides a highly efficient, low-drag design having a high-lift multi-airfoil technology.

The invention in some preferred embodiments introduces constant accelerating airfoil features that may eliminate circulation and produce strong boundary layer control. The multi-airfoil features, and as may be provided in embodiments with a multi-dimensional lift and thrust propulsion system and fan, can produce instant take-off and accelerate to higher speeds than is possible with traditional technologies such as helicopters or propeller-driven aircraft. Yet, the present invention has hover capabilities and preferred three-dimensional flight control, even in low or no flight speed scenarios, that are applicable in even no power or stall applications.

The invention in some embodiments is directed to air flow technologies in tangential or cross flow fan systems, as well as to airfoil technologies for aeronautic and ground-effects applications, among others. The invention in some embodiments comprises technologies addressing preferred air flow, lift, and thrust and the reduction of drag and circulation losses. Accordingly, the invention may be particularly applicable to aeronautic applications and ground-effects type vehicle design and operation, such as military and aerospace applications for aircraft, shuttles, and other vehicles, as well as primarily surface-based vehicles such as amphibious vehicles and hovercraft. The invention may be further applicable and have particular interest for incorporation in aircraft and other vehicles wherein the ability to maximize initial vertical lift and take-off is important as well as the ability to hover.

The invention is also directed to propulsion systems that are scalable, such that the amount of lift and thrust required for a particular application, such as transport vehicles, may take the form of surface-based vehicles, ground-effects type vehicles, or aircraft, shuttles or the like, while accommodating large loads and maintaining the advantages of maneuverability, immediate take-off, flight and hover control, as well as landing. In some embodiments the scalability of the technology may provide for doubling of the air speed within the system to a corresponding eight fold increase in lift. In still further embodiments, the scalability of the invention may allow for an increase in dimensions of the fan diameter and length so as to accommodate a wide variety of lift and thrust requirements, or in reduced requirement applications for lift and thrust while maintaining other preferred characteristics such as control for applications such as un-manned vehicles or remote applications, as in reconnaissance applications or even model or toy technologies.

The invention provides preferable lift characteristics in some embodiments by the incorporation of constant accelerating airfoils that preferably utilize a thin and relatively less broad airfoil configuration. The constant accelerating airfoils not only have themselves preferred aerodynamic characteristics such as minimized drag effects but have different and preferred lift characteristics from traditional airfoils as air can be directed to one or a plurality of the constant accelerating airfoils for boundary layer flow, greater lift, and to achieve instantaneous lift and thrust. In preferred embodiments airflow is directed to the one or a plurality of constant accelerating airfoils from an airflow source such as a cross flow fan. The control of the vehicle by the invention can then be obtained by varying the angle of air flow into and through the fan as well as the angle of air flow at the constant accelerating airfoils and at the exhaust.

The invention is not a technology that might be considered only one dimensional in that traditional technologies such as helicopters, prop aircraft and jets require achieving a linear speed of the vehicle in order to generate a sufficient airflow speed in order to achieve sufficient thrust, or must achieve a vertical movement before forward motion is possible, as in the helicopter. The present invention can provide lift instantaneously or otherwise to achieve and allow take-off at a non-moving initial position, such as instant take-off and landing, even to provide banking, hovering, and turning capability while in flight or from take-off In some embodiments, one or more propulsion systems are provided such that each propulsion system has speed and attitude control to affect the direction of flight or hovering, such as, in some embodiments, providing a propulsion system having two propulsion apparatus jointly controlled. The present invention also can control the amount of lift and thrust and combinations thereof through one control of the system that may not be afforded by traditional technologies. Accordingly, the invention may be considered multi-dimensional in having one system that produces lift, thrust and control.

The present invention has lifting characteristics that are different than traditional technologies in that in some preferred embodiments airflow is directed to a plurality of airfoils that as a system can produce exhaust air flow at least to 250 miles per hour. In some preferred embodiments, the cross flow fan is capable of producing exhaust air speeds at least to 250 miles per hour or greater, depending upon the scalable nature of the invention and the application intended. Alternatively, in some embodiments, the invention is a jet propulsion system, providing in combination with ram jet engine features of the invention a propulsion system that has further increased thrust and lift to provide increased speed and maneuverability.

The cross flow fan in some embodiments is the primary rotating component that may rotate at relatively slow speeds so that mechanically dependent systems such as traditional bearings can be incorporated. Furthermore, the exhaust air speed for some preferred embodiments may be two and one-half times the tip speed of the fan that may allow for low maintenance and simplicity.

Furthermore, the combination of a plurality of constant accelerating airfoils in the present invention hold boundary layer airflow close to the airfoils, channeling air for more laminar flow than traditional technologies and achieve more air flow and propulsion while also achieving more direction and control via the lift characteristics of the airfoils and the configuration of the system and features overall, while minimizing drag and unwanted circulation and turbulence. The control provided by the present invention over the lift and thrust and the propulsion of the system generally afford not only instant or non-moving initial position lift and take off, and the ability to hover, but the ability to level off or adjust lift characteristics of the airfoils and provide lift and thrust from the cross flow fan. The effects from the plurality of airfoils can be utilized in controlled take off and landings, as well as in adjustment of the attitude and direction of the vehicle in flight. The invention further may minimize unwanted control issues and forces created by traditional technologies such as helicopters and other fan-based technologies wherein side to side or lateral torque forces are not present as they are in these axial fan based systems.

The invention as a propulsion system creates an intake airflow that may be seen to correspond to a flying speed for traditional technologies, allowing for preferred hovering and non-moving initial position lift and take-off, as well as preferred multi-dimensional flight control and low speed or even hovering control. The invention is also accordingly less affected by wind direction and velocity. The invention may have preferred applications wherein the advantages of multi-dimensional flight control, low speed or even hovering control, and non-moving initial position and take-off are fully realized, such as in environments having a limited area for take-off and landing of the vehicle, or where the surface for take-off and landing is unstable or even moving. An example of such preferred application would be in the take-off, landing and hovering above boats or ships such as aircraft carriers or even waves of an ocean or lake.

In preferred embodiments, the invention has manifold features that control thrust and lift, and propulsion generally, as well as the ratio of thrust and lift. The present invention avoids adverse torque reaction given the cross flow fan torque may be parallel to the direction of travel of the vehicle, and may eliminate undesired tendencies of traditional propeller-driven aircraft such as, but not limited to, left turning tendencies.

Further embodiments are new vehicle types and alternatively may be modification to existing vehicles, each in accordance with the present invention. Traditional vehicles modified to have the features and advantages described herein are disclosed as vehicles in accordance with the present invention.

In still further embodiments, the invention may incorporate ram jet engine technology such as ram jet features so as to provide not only preferred take-off, flight, and landing characteristics but to also afford the benefits of the amount of propulsion that can be generated from the jet feature. The invention allows for the propulsion of the jet to be utilized in combination with airflow propulsion and airflow intake to combine for producing combinations of lift and thrust. In alternative embodiments, a non-jet embodiment would provide a minimized thermal profile that may be advantageous particularly for military applications. Further, the scalability of the invention can allow for large and massive transport applications or reduced size and preferred control for reconnaissance applications such as in Predator-type remote and unmanned vehicles and even toy or model applications.

Accordingly, in some embodiments, the invention is a vehicle propulsion apparatus, having a cross flow fan and a manifold in fluid communication with the cross flow fan. An air intake is also provided having at least one port in fluid communication with the cross flow fan, while an air discharge is in fluid communication with the cross flow fan. The air discharge in some preferred embodiments provides propulsion from air from the cross flow fan and the manifold controls lift and thrust from air from the cross flow fan.

In further embodiments of the invention, a vehicle propulsion apparatus is disclosed having a cross flow fan and a manifold rotatably adjustable to provide lift and thrust from air from the cross flow fan.

The invention in alternative embodiments is a vehicle propulsion apparatus, having a cross flow fan, a ram jet engine, and a manifold in fluid communication with the cross flow fan and the ram jet engine. The ram jet engine in preferred embodiments is of a ram jet design; however alternative embodiments have other types of jet engines such as a turbine engine. An air intake is also provided having at least one port in fluid communication with the cross flow fan, while a cross flow fan air discharge is in fluid communication with the cross flow fan and the jet engine. The cross flow fan air discharge in some preferred embodiments is in communication with a ram jet engine air intake, in some embodiments a diffuser. A discharge in some preferred embodiments provides propulsion from air flow from the manifold and from the ram jet engine. Air flow from the manifold in combination with the thrust created by the ram jet engine controls lift and thrust while air from the cross flow fan provides assisted air intake for the ram jet engine.

In further embodiments of the invention, a vehicle propulsion apparatus is disclosed having a cross flow fan, a manifold, and a ram jet engine, wherein the ram jet engine and the manifold are rotatably adjustable to provide lift and thrust from air from the cross flow fan.

Methods of propulsion are disclosed, and in some embodiments, are methods of propulsion having the steps of directing air from a cross flow fan through a manifold and providing lift by a plurality of airfoils from air from the cross flow fan. The invention provides for the propulsion from air from the cross flow air fan and further adjusting the manifold to provide lift and thrust from air from the cross flow fan. In some embodiments adjustment of the plurality of airfoils achieves lift and thrust from the cross flow fan.

Further methods of propulsion are also disclosed, and in some embodiments, are methods of propulsion having the steps of directing air from a cross flow fan through a jet air intake of a ram jet engine, directing air from an air intake through a manifold, and providing lift by a plurality of airfoils from air from the air intake and the propulsion of the ram jet engine. The invention provides for the propulsion from air from the manifold and the ram jet engine and further adjusting the manifold to provide lift and thrust from air from the manifold and the ram jet engine.

In each of the embodiments of the invention a plurality of airfoils can provide lift from air from the cross flow air fan or from air introduced into the manifold, or both. In some preferred embodiments the airfoils are constant accelerating airfoils having preferred characteristics in air flow and lift, and in some embodiments provide preferred boundary layer airflow about the airfoils, in some preferred embodiments minimizing unwanted recirculation and turbulence. In still further embodiments, a plurality of airfoils may be part of the air discharge, while additional plurality of airfoils can be made part of companion air intake to enhance the flow of air and further improve lift and thrust characteristics. In additional embodiments, the invention is a vehicle in accordance with the disclosure herein.

Additional apparatus, assemblies, and systems are disclosed herein. Still other methods such as those corresponding to each apparatus and assemblies are also disclosed, as well as methods of doing business. Applications may include the propulsion of vehicles as well as takeoff, flight, attitude and direction adjustment, landing, hovering and positioning of those vehicles, as well as other propulsion, lift and thrust solutions and may be provided in combination with other propulsion technologies such as jet engines.

Embodiments the present invention provide for a combination advantages, some of which may be described previously and further described as: instant take-off and landing; hover capabilities for fixed wing aircraft; functional jet capabilities such as in linear RAM jet capabilities with no forward movement requirement; three dimensional flight control and no or slow flight speeds; high speed laminar air flows around lifting and control surfaces even at a stop or no or low flight speed; laminar air flow offering boundary layer control; rotating manifold features offering greater lift when needed; an angle of attack of the system may be considered fixed relative to the manifold and multi-airfoils that addressing stalling factors; no or minimized adverse torque reaction; a torque reaction that contributing to lift; controlled flight in loss of power or stall situations; sufficient lift with less wing surface; thin, high aspect ratio airfoils reduce drag, weight, and storage space; low thermal signature for stealth applications; a design providing lower costs in simple maintenance configurations.

Still other methods such as those corresponding to each apparatus and assemblies are also disclosed. Applications may include propulsion systems generally, having preferred lift and thrust characteristics, as well as propulsion solutions embodied as an entire vehicle, as in aircraft, space craft, land craft, water craft, hover craft, and others, and may be provided in combination with other aeronautic technologies.

BRIEF DESCRIPTION OF THE DRAWINGS

FIG. 11A is a front isometric view and 11B is a back isometric view.

DETAILED DESCRIPTION OF PREFERRED EMBODIMENTS OF THE INVENTION

Figure 1:
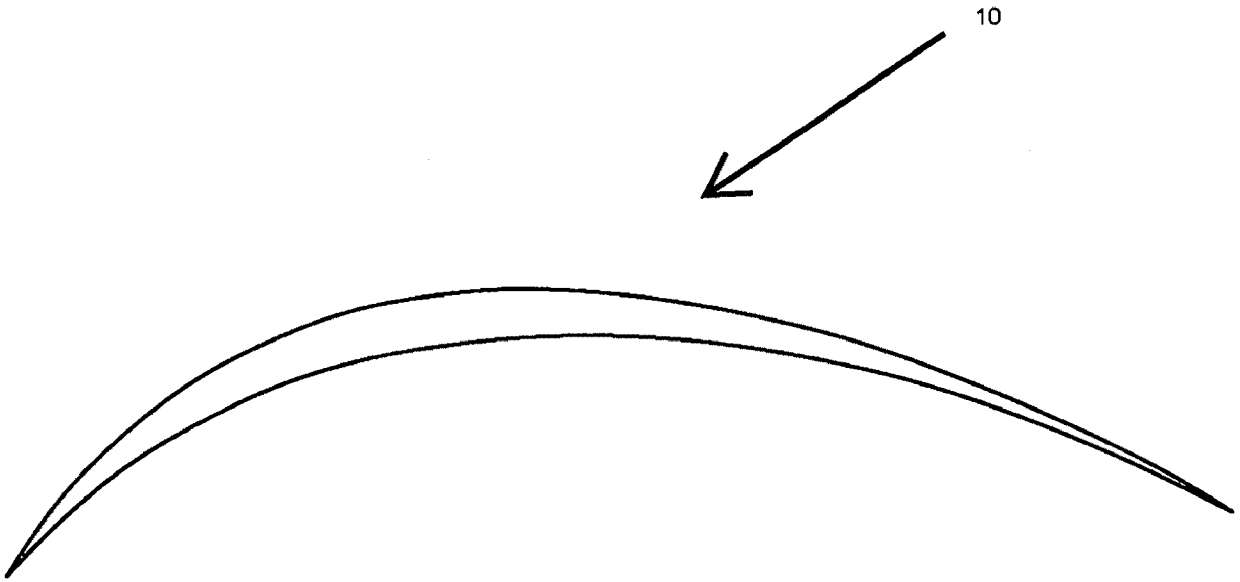
FIG. 1 is a side view of one embodiment of an airfoil in accordance with the present invention.

The present invention is described in preferred embodiments that address one or more inadequacies of the prior art. Accordingly, embodiments of the invention are shown and described in the Figures, summary of the invention, written description, and claims and throughout the disclosure of this application, as one or more apparatus, assemblies, processes, and methods.

The present invention is herein described as embodiments of vehicles and methods of propulsion, wherein vehicles may be any transport system or technology, such as, but not limited to, vehicles generally, and aeronautic applications and ground-effects type vehicle design and operation, such as traditional private and commercial aircraft, as well as military and aerospace applications for aircraft, shuttles, and other vehicles, as well as primarily surface-based vehicles such as amphibious vehicles and hovercraft. The term vehicle may reference aircraft, space craft, land craft, water craft, hover craft, and others, in accordance with the present invention. The term vehicle may also be construed to be modification to existing vehicles or unique vehicles, each in accordance with the present invention. Traditional vehicles modified to have the features and advantages described herein are disclosed as vehicles in accordance with the present invention. The term vehicle should be accordingly broadly construed in light of the present invention.

Furthermore, the present invention has features described herein in some embodiments as a constant accelerating airfoil or airfoils. A constant accelerating airfoil is an airfoil having the characteristics of increased flow velocities and pressure differentials for lift, while provide a constant pressure at all angles of attack. In some embodiments, the invention may be achieved by utilizing a straight curve profile that creates a constant pressure under the airfoil and constant and reduced pressures above the airfoil. In still further embodiments, a more even distribution of pressure is achieved for each airfoil, creating greater stability than traditional airfoil designs. Alternative embodiments may provide reinforcement elements to further the stability of multiple airfoils.

Embodiments of the present invention may also feature preferred flow characteristics that may be achieved from a plurality of constant accelerating airfoils. Broadly construed, the plurality of airfoils, as constant accelerating airfoils, hold the airflow boundary layer about the airfoils close to the surface, under what may be described in some embodiments as high siphon pressure. The air flow about the airfoils may also be described as air flow under low static pressure for high air flow velocity to achieve preferred boundary layer flow, the prevention or minimization of recirculation and turbulence, and constant lift on the airfoils. The increased lift and acceleration of air flow about and through the airfoils is further described below.

In some embodiments, the air is channeled through the system and about the airfoils such that there is minimized turbulence, unwanted drag and recirculation, allowing for compressed air through the system, air accelerated by low pressure zones preferentially created within the cross flow fan and the manifold to accelerate air flow, to achieve greater lift and thrust from the system, overall preferred multi-dimensional flight control and low speed or even hover control, turning, banking, and for the full propulsion of a vehicle.

Accordingly, vehicle propulsion apparatus, systems and methods of propulsion are disclosed, as well as embodiments of fans and airfoils, technology that in some applications of the invention provide lift and thrust, and propulsion. FIGS. 1 through 21 describe embodiments of the present invention, directed to the production of lift and thrust, and propulsion, produced from air flow. In some preferred embodiments a cross flow fan produces air flow, while in alternative embodiments a cross flow fan provides intake to a ram jet engine. One or a plurality of propulsion apparatus may be provided for a vehicle in order to achieve overall preferred multi-dimensional flight control and low speed or even hover control, turning, banking, and for the full propulsion of a vehicle.

Figure 2:
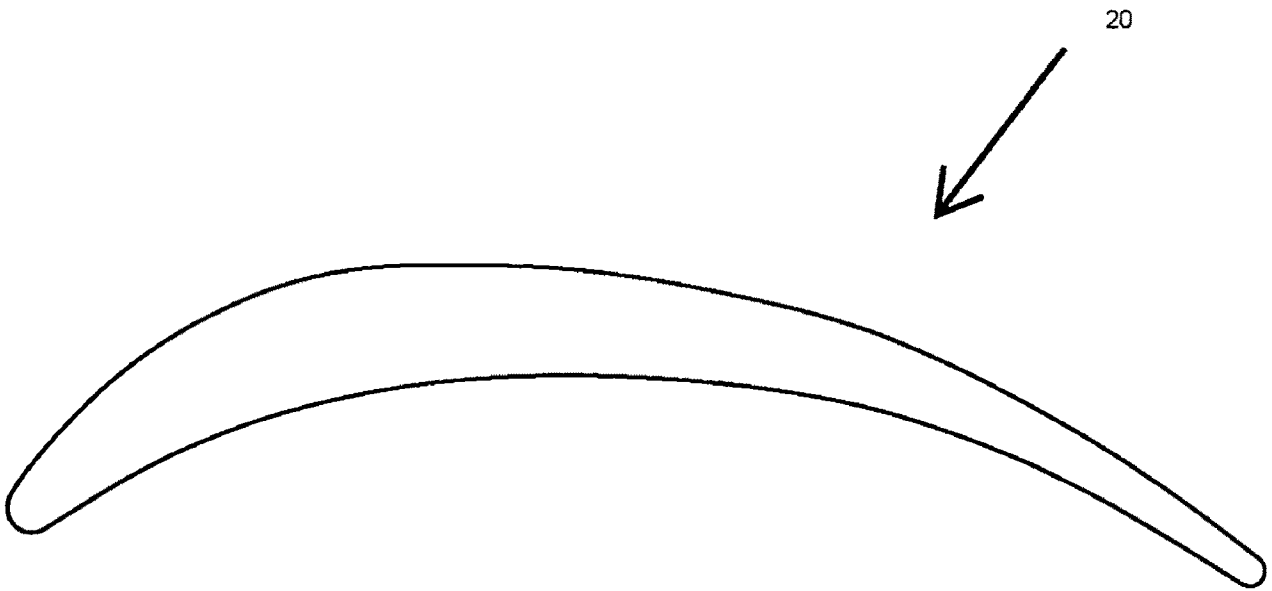
FIG. 2 is a side view of a second embodiment of an airfoil in accordance with the present invention.

Now, in reference to FIG. 1, a constant accelerating airfoil 10 is described. As previous defined, airfoil 10, in preferred embodiments, has characteristics of increased flow velocities and pressure differentials for lift, while providing a constant pressure at all angles of attack. The accelerating airfoil 10 utilizes a straight curve profile that creates a constant pressure under the airfoil and constant and reduced pressures above the airfoil. FIG. 2 describes a second constant accelerating airfoil 20, having similar characteristics as a constant accelerating airfoil while providing a different configuration and angle of attack. In some embodiments, airfoils have a decreasing radius from leading edge to the trailing edge of the airfoil over the top and bottom at a constant rate. The angle of the top and bottom surface may change to renew the boundary layer created with air flow, and thus a changing downward acceleration of air allowing for easier control of the boundary layer and facilitating other features of the present invention.

Figure 3:
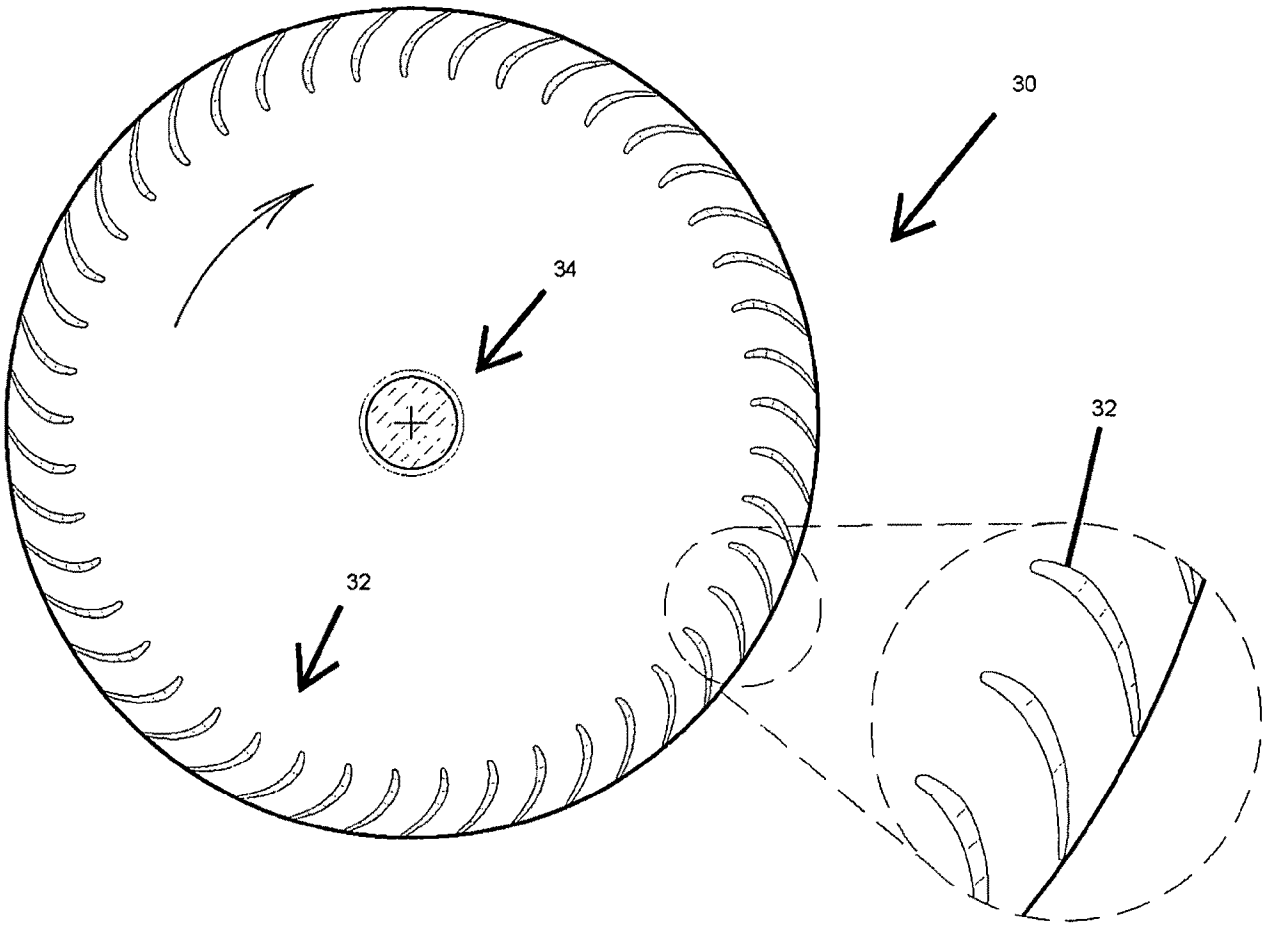
FIG. 3 is a side and partial cross-section and enlargement of a cross flow fan in accordance with the present invention.

Now in reference to FIG. 3, a cross flow fan 30 is described in accordance with the present invention. The cross flow fan may incorporate a plurality of constant accelerating airfoils 32, and in preferred embodiments feature fan blades that each comprise a constant accelerating airfoil. The cross flow fan 30 rotates about a center 34 and a mechanical element such as a bearing or other mechanical feature allowing for rotation of the cross flow fan. Rotation of the fan in some preferred embodiments creates pressure differentials and pressure zones within the fan similar to the configuration of pressures described in U.S. Pat. No. 6,261,051 issued to Kolacny, the description of which is herein incorporated by reference, and as described below with reference to FIGS. 16 through 19. The output of the cross flow fan may serve to provide lift, thrust and propulsion as further described below, and in alternative embodiments, may provide for the intake to a propulsion feature such as a ram jet engine.

The cross flow fan 30, in accordance with other features of the present invention, such as the configuration of a manifold and air intake and air discharge elements and their surfaces, may create pressure zones within the fan from intake air into the fan forming higher and lower pressure zones. The higher pressure zones generated at the output of the fan allow for an increase in exhaust flow at speeds that afford unique aspects of the present invention. In combination with the preferred plurality of constant accelerating airfoils 32, airfoils that improve the fan production and flow and having the characteristics previously described, create advantageous exhaust air flow. Rotation of the fan is shown in example in one direction in FIG. 3; however, the present invention affords rotation of the fan in the opposite direction, affording further advantages. In one example, rotation of the fan may be powered independently by a power source, such as an onboard engine or other powering means. However, in some embodiments, an unpowered state of the fan may still afford a rotation of the fan in an opposite direction, driven by airflow created by the movement of vehicle, and thus the lift, thrust and propulsion features described herein.

The curvature of the fan blades as constant accelerating airfoils 32 and the clockwise motion toward the air source, forces the air inside the fan compartment and directs it on to portions of the fan compartment, thus increasing air pressure. This may be described with reference to FIG. 4, wherein the vehicle propulsion apparatus 100 is described. Therein, a cross flow fan 102 is in fluid communication with a manifold 104. An air intake 106 having at least one port 108 in fluid communication with the fan is provided at the front of the apparatus 100 and an air discharge 110 is also provided in fluid communication with the fan. The manifold 104 is rotatable about a central axis 112 of the fan, as described in FIGS. 4 and 5. Accordingly, the manifold 104 is rotatably adjustable and results in control of lift, thrust and propulsion, as well as overall preferred multi-dimensional flight control and low speed or even hover control, turning, banking from air produced from the fan 102. Furthermore, the air discharge may have a plurality of constant accelerating airfoils 114 providing lift from air from the fan 102.

Figure 13:
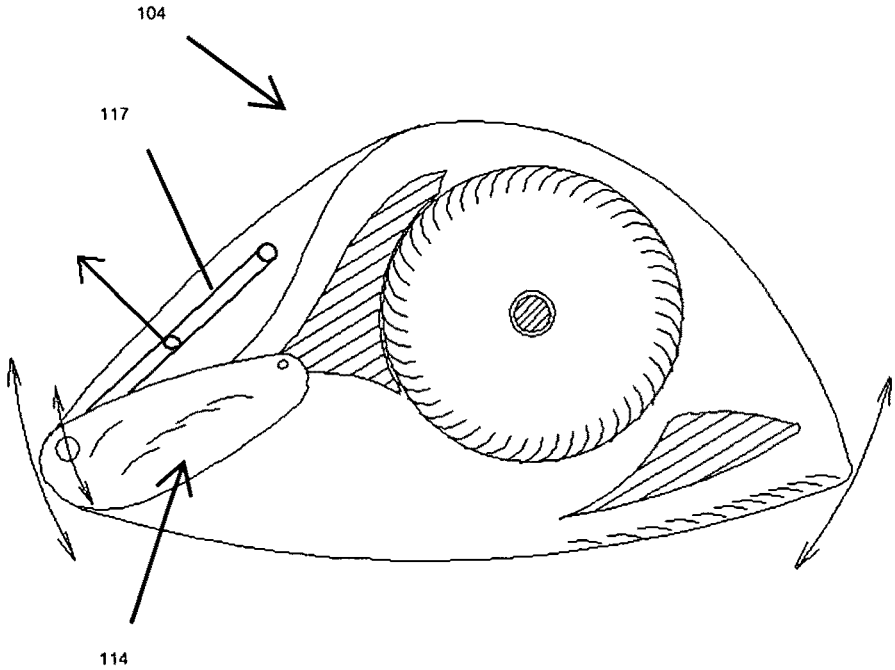
FIG. 13 a side and partial cross-section of an embodiment of the present invention.
Figure 14:
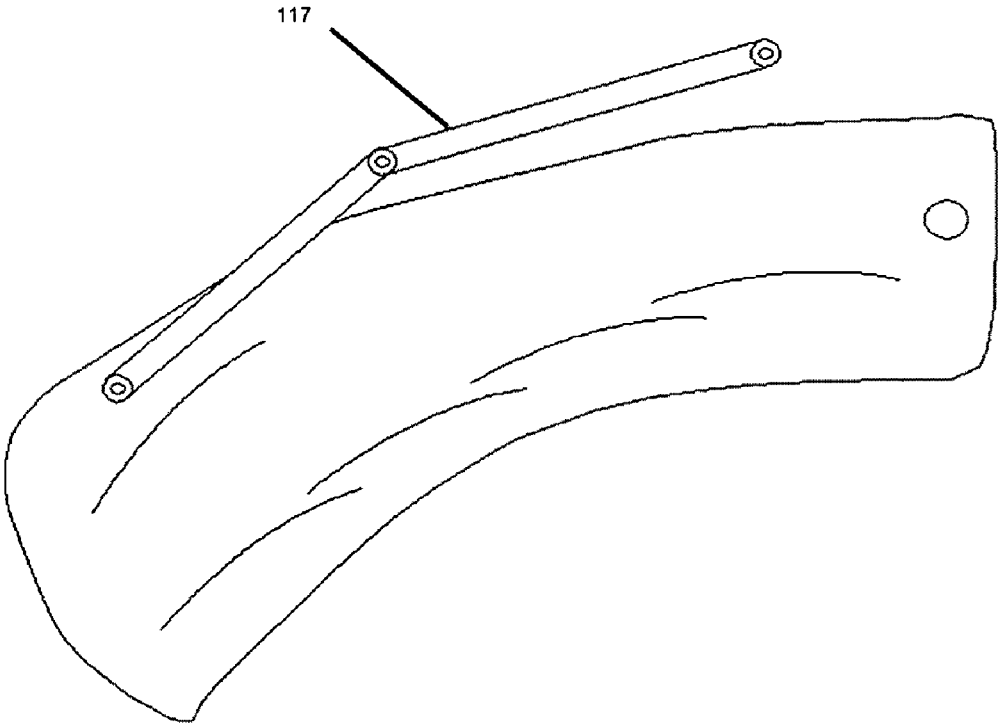
FIG. 14 is a side view of features of the embodiment of FIG. 13.

The lift provided by the constant accelerating airfoils 114 is a function not only of the design of the airfoils, but also is lift that corresponds to the orientation of the manifold 104, controlling the direction of the resultant lift forces and propulsion from the apparatus 100. In still further embodiments, as shown in FIGS. 13 and 14, an adjustment element 117 may provide further adjustment of the constant accelerating airfoils 114, adjustment that may be coordinated with or independent of the orientation or rotational adjustability of the manifold 104. Although adjustment element 117 is described in the figures as a hinged adjustment element, other mechanical elements may be incorporated to provide for the adjustment of the constant accelerating airfoils 114, and may comprise a traditional lift mechanism as may be used with traditional flaps.

In accordance with the present invention, the airfoils 114, as constant accelerating airfoils, advantageously provide boundary layer airflow about the airfoils, and in preferred embodiments, accordingly minimize drag corresponding to boundary layer airflow about the foils. Furthermore, the rotatable adjustability of the manifold, and the other features of the invention about the fan, allows for the lift generated by the airfoils 114 to be controlled. Furthermore, as airflow is generated from the fan, thrust is produced and controlled from the air discharge 110. Additionally, a plurality of constant accelerating airfoils 118 may be provided at the front of the apparatus, and in preferred embodiments below the air intake, to afford greater lift and thrust characteristics as further described below. The lift provided by the constant accelerating airfoils 118 is also a function not only of the design of the airfoils, but also is lift that corresponds to the orientation of the manifold 104, controlling the direction of the resultant lift forces and propulsion from the apparatus 100. Accordingly, thrust created from the airfoils 114, 118 may also be a function of the design of the airfoils and corresponding to the orientation of the manifold 104.

In some embodiments, operation may be described wherein the airfoils of the fan 102 and their characteristics as constant accelerating airfoils, as well as the rotation of the fan in the direction of an air source, in some embodiments a clockwise motion, forces air inside the fan compartment and directs the air from the front side of the compartment wherein centrifugal force and the increasing pressure of the incoming air, hold increasing air pressure against incoming air at lower portions 118 of the interior of the fan compartment, creating lower pressure zones at upper portions 120. Incoming air cannot enter the compartment in high pressure zones and will then be released as pressured air to outside the lower rear of the fan and out the discharge 110 and about the airfoils 114.

Fan blade curvature forces air to be accelerated outside from and to the rear of the fan. This accelerates the air, in some embodiments, to about three times the tip speed of the fan. The higher the RPMs of the fan, the more air is evacuated from the fan compartment, resulting in a vacuum for the apparatus 100 and the fan and intake 106 and port 108. Air is preferably not introduced in the low pressure zones of the fan compartment as the manifold 104 prevents outside air from entering, such as at 120, 122, until intake air is introduced. Furthermore, in some embodiments, air channeling may be created within the fan wherein partitions 207, shown in FIG. 8, extending as plates the extent of the diameter of the fan in preferred embodiments, channel airflow through the fan, helping to further eliminate circulation airflow and increasing efficiency. The partitions 207 may also serve as reinforcements to the high aspect ratio embodiments of airfoils utilized, airfoils that are elongated about the lateral extent of the airfoil and having a relatively short front to back profile.

Figure 9:
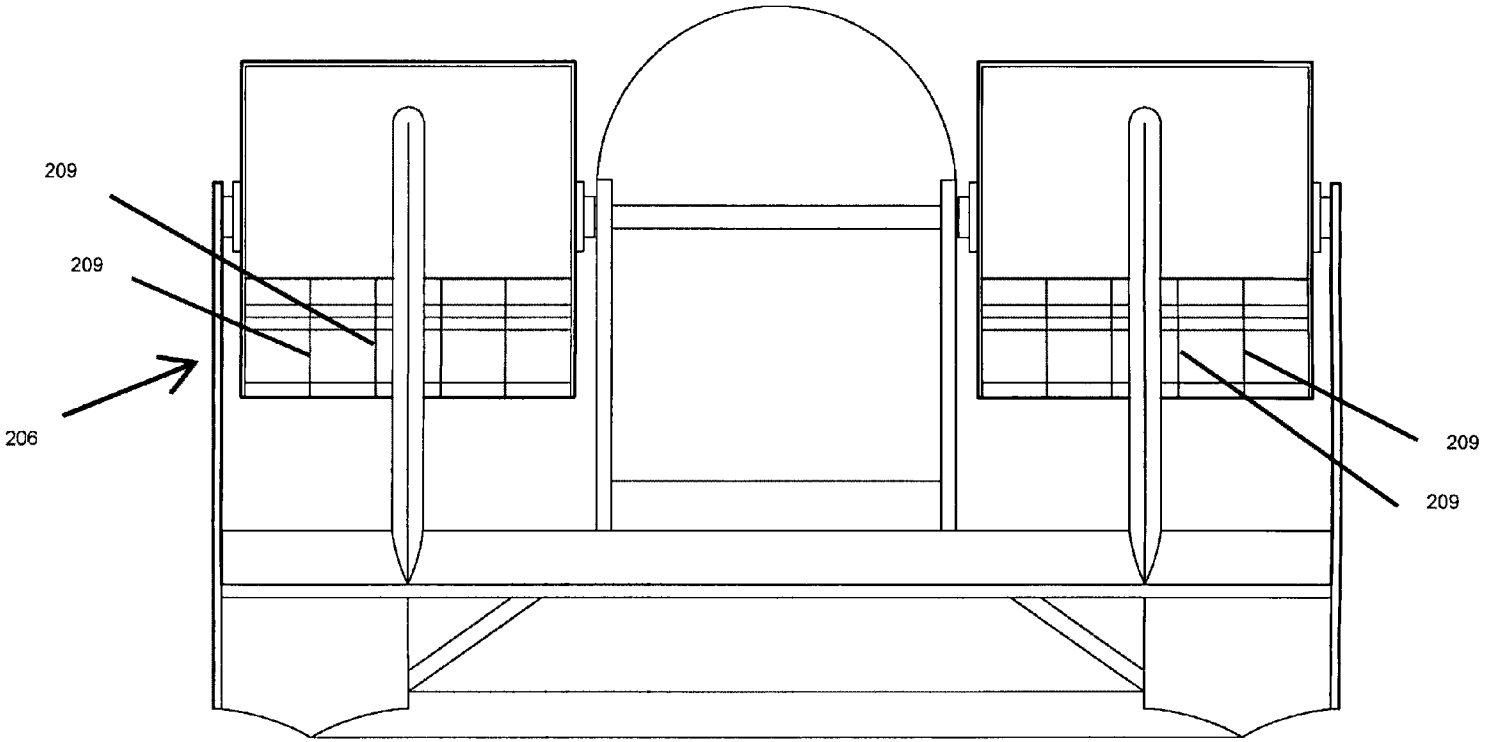
FIG. 9 is a back view of the embodiment of FIG. 7.
Figure 10:
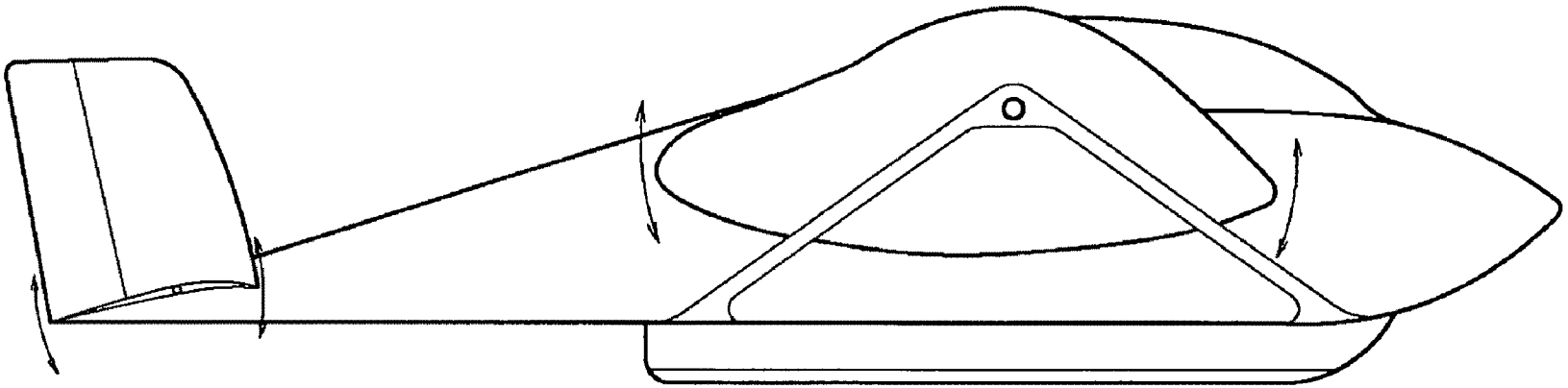
FIG. 10 is a side view of the embodiment of FIG. 7.
Figure 11:
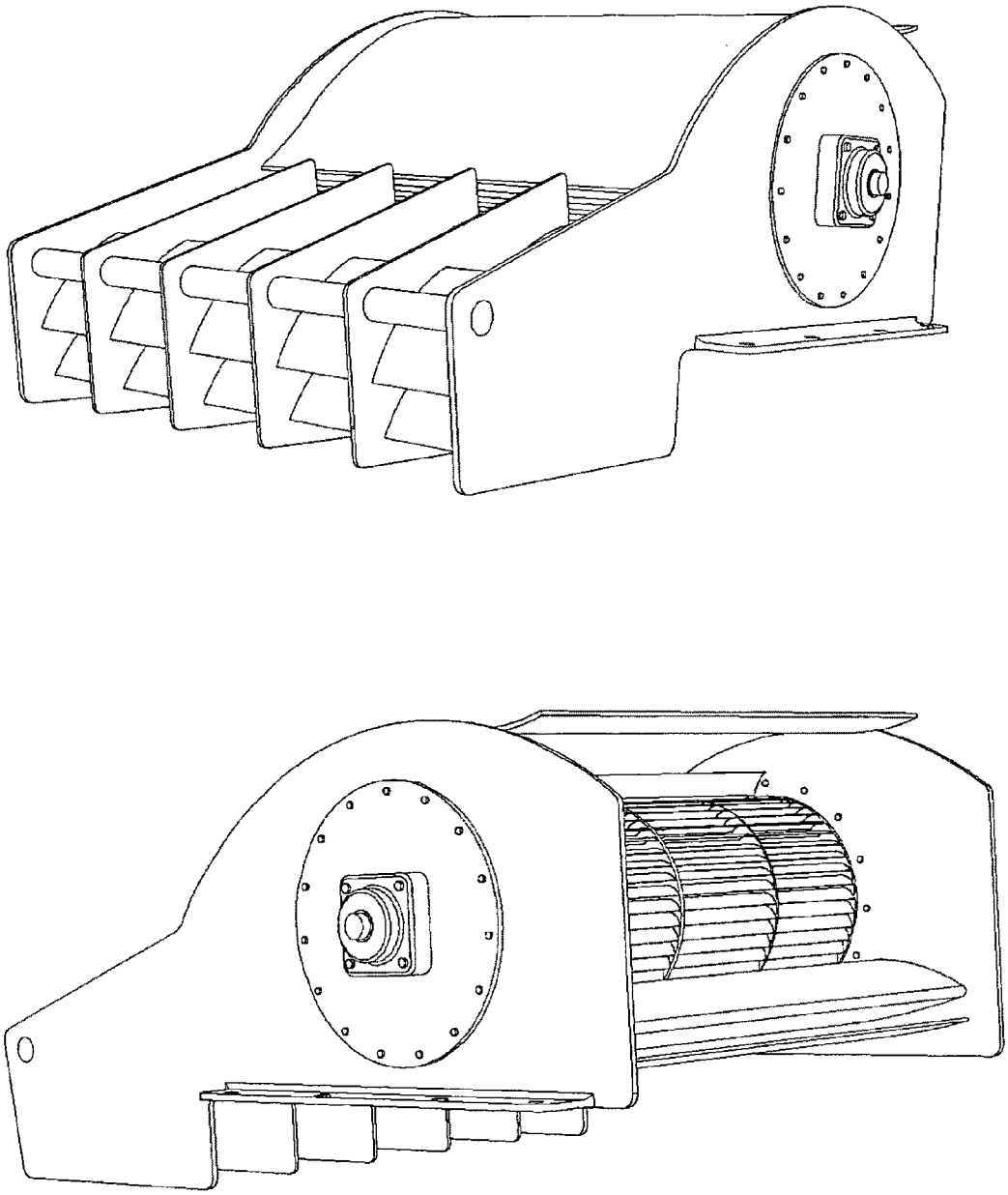
FIG. 11 are isometric views of an embodiment of the present invention.
Figure 12:
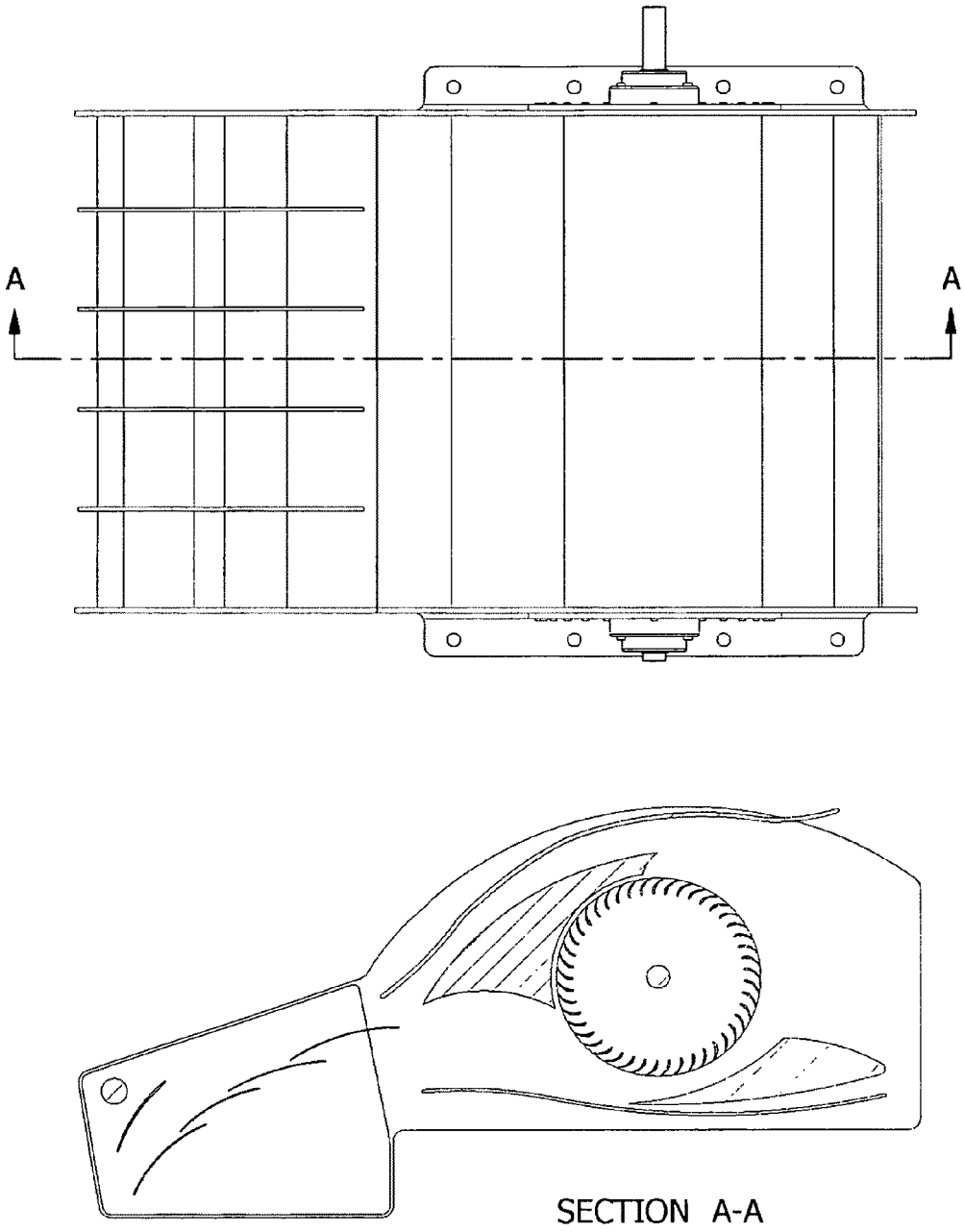
FIG. 12 are top and cross-sectional views of the embodiment of FIG. 11.
Figure 15:
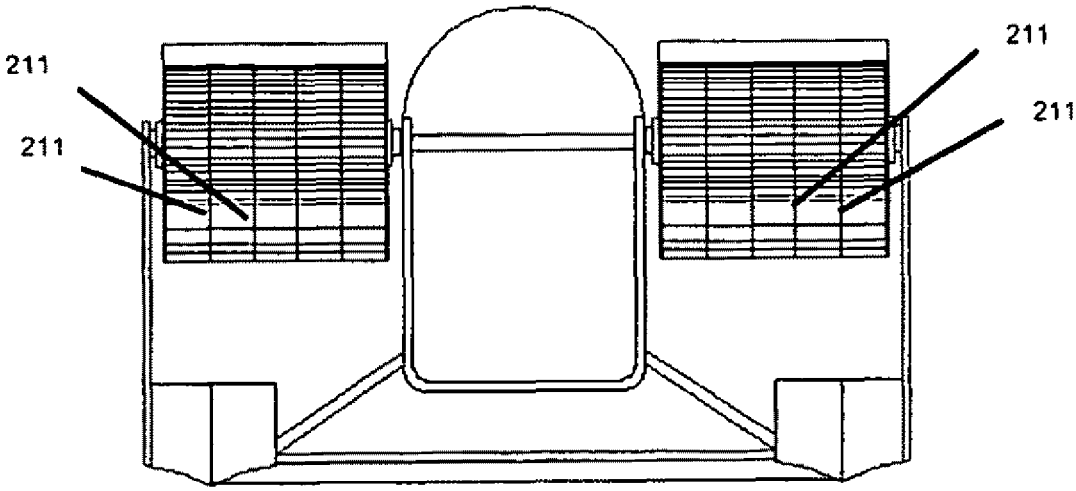
FIG. 15 is a front view of an alternative embodiment to the embodiment of FIG. 8.

In still further embodiments, air channeling may be created within the constant accelerating airfoils 114 and/or 118, wherein for example partitions 209, shown in FIG. 9, extending as plates the extent of the plurality of constant accelerating airfoils 114 in preferred embodiments, channel airflow through the airfoils, and helping to further eliminate circulation airflow and increasing efficiency. The partitions 209 may also serve as reinforcements to the high aspect ratio embodiments of airfoils utilized, airfoils that are elongated about the lateral extent of the airfoil and having a relatively short front to back profile. A similar arrangement of airfoils 118 and partitions 211 are shown in FIG. 15.

Accordingly, the system is more efficient in its design and operation in affording higher RPMs and exhaust CFM (cubic feet per minute) with less power than may be required to drive traditional systems. In some preferred embodiments, results have shown that in scaling the apparatus, and in some embodiments scaling simply the cross flow fan to double its diameter in accordance with the present invention, yields CFMs that are ten times greater. In still further embodiments, having exhaust air speeds that are three times the tip speed of the fan can generate resulting propulsion and thrust to achieve overall speed potentially to the speed of sound.

In still further embodiments of the invention, and as may have been previously described, the plurality of constant accelerating airfoils 114, configured in the exhaust air of the fan 102, counteract the torque reaction created in operationally rotating the fan 102, wherein in the example described, a clockwise rotation of the fan 102 may generate torque on the apparatus in the opposite direction, a force that is counteracted by the lift generated by the airfoils 114 as air passes over and through the airfoils. However, and more generally, the airfoils 114 create preferential lift simply as air flows over and through the airfoils as inherent in their being constant accelerating airfoils. As the airfoils 114 are, in some embodiments, fixed in relation to the manifold 104, and alternatively adjustable as previously described and as shown in FIGS. 13, 14, the lift generated by the airfoils are controlled, as well as resultant thrust output from discharge 110 and airfoils 114. Accordingly, the manifold and the airfoils 114, 118, as well as the discharge and air intakes and ports are rotatably adjustable to direct air at any angle for controlled thrust and lift.

Figure 4:
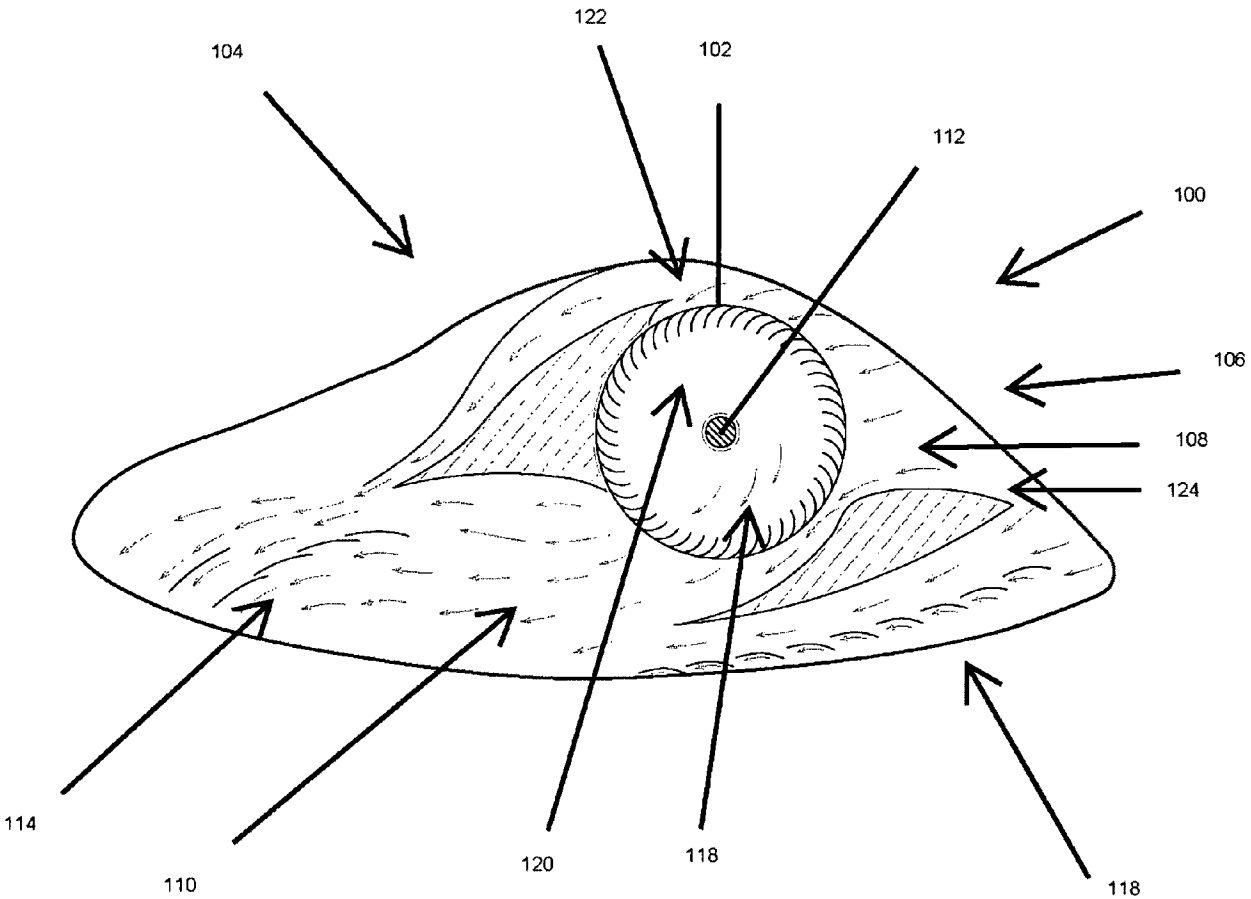
FIG. 4 is a side and partial cross-section of an embodiment of the present invention.
Figure 5:
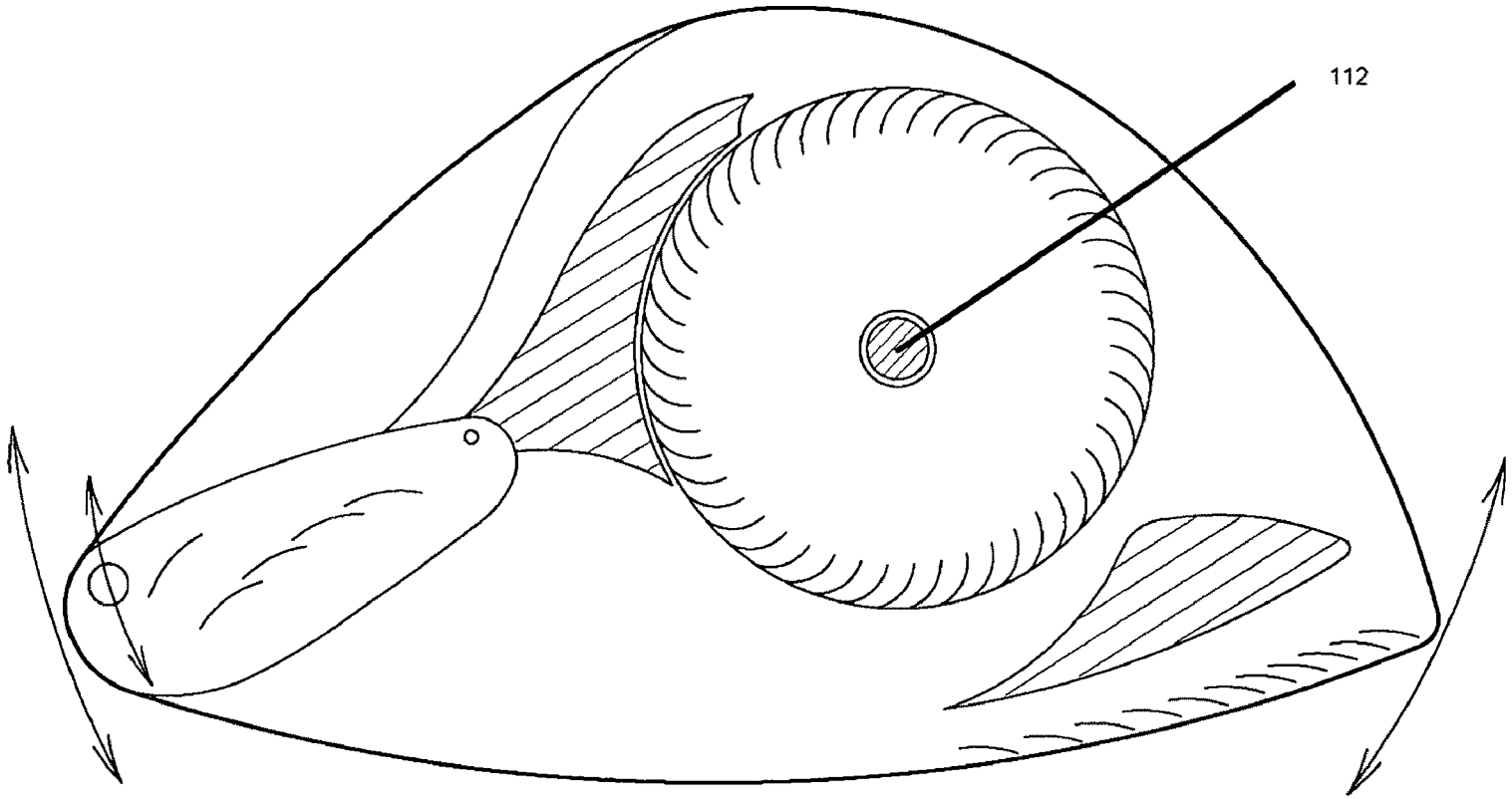
FIG. 5 a side and partial cross-section of a second embodiment of the present invention.
Figure 6:
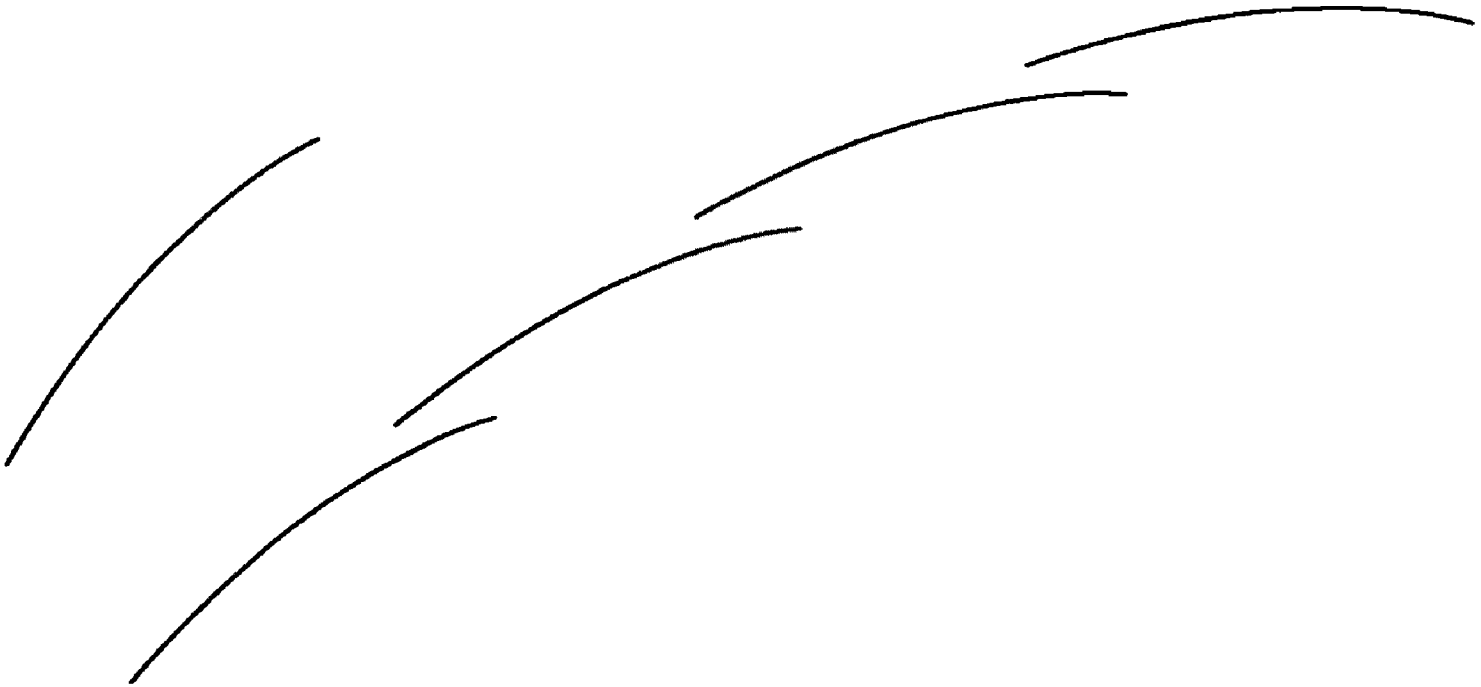
FIG. 6 is side view of an embodiment of a plurality of airfoils in accordance with the present invention.

FIGS. 4 and 5 describe preferred configurations of constant accelerating airfoils 114, 118; however, other configurations may be provided in accordance with the present invention and as understood by one skilled in the art. Some embodiments, for example, may provide for only one constant accelerating airfoil 114 or 118, or even no airfoil or airfoils 118. Each of these alternatives or the combination thereof is within the scope and disclosure of the present invention. FIG. 6 is one embodiment of constant accelerating airfoils. In this embodiment, the airfoils may be considered at a maximum angle of attack. However, and independent of the example provided in FIGS. 4, 5 and 6, the airfoils can be configured to an increasing or decreasing angle of attack, depending upon the preferences in control and in lift and thrust, as well as the particular application. Changing the angle of attack may, for example, eliminate produced lift, if necessary, or generate a desired amount of lift. In one example, a fifteen degree angle of attack may be preferred.

Again, and now further in relation to the constant accelerating airfoils shown in FIG. 6, and with respect to the constant pressures as previously described regarding these airfoils, air flow may be pulled in between each of the airfoils given the configuration and even, in some embodiments, the venture configuration between each airfoil, resulting in air moving potentially twice as fast or more than air flow about the airfoils, allowing for preferred boundary layer control about the plurality of airfoils. The configuration would afford single layer boundary air flow control. Again, and in preferred embodiments, air may be channeled by channel or reinforcement elements, in some preferred embodiments every 6 to 8 inches of the extent of the airfoils, providing for further efficiency in airflow. Furthermore, the channeled airflow will increase the amount of lift while allowing for reinforcement features to the airfoils to help prevent deformation such as bending due to forces generated in operation.

Figure 7:
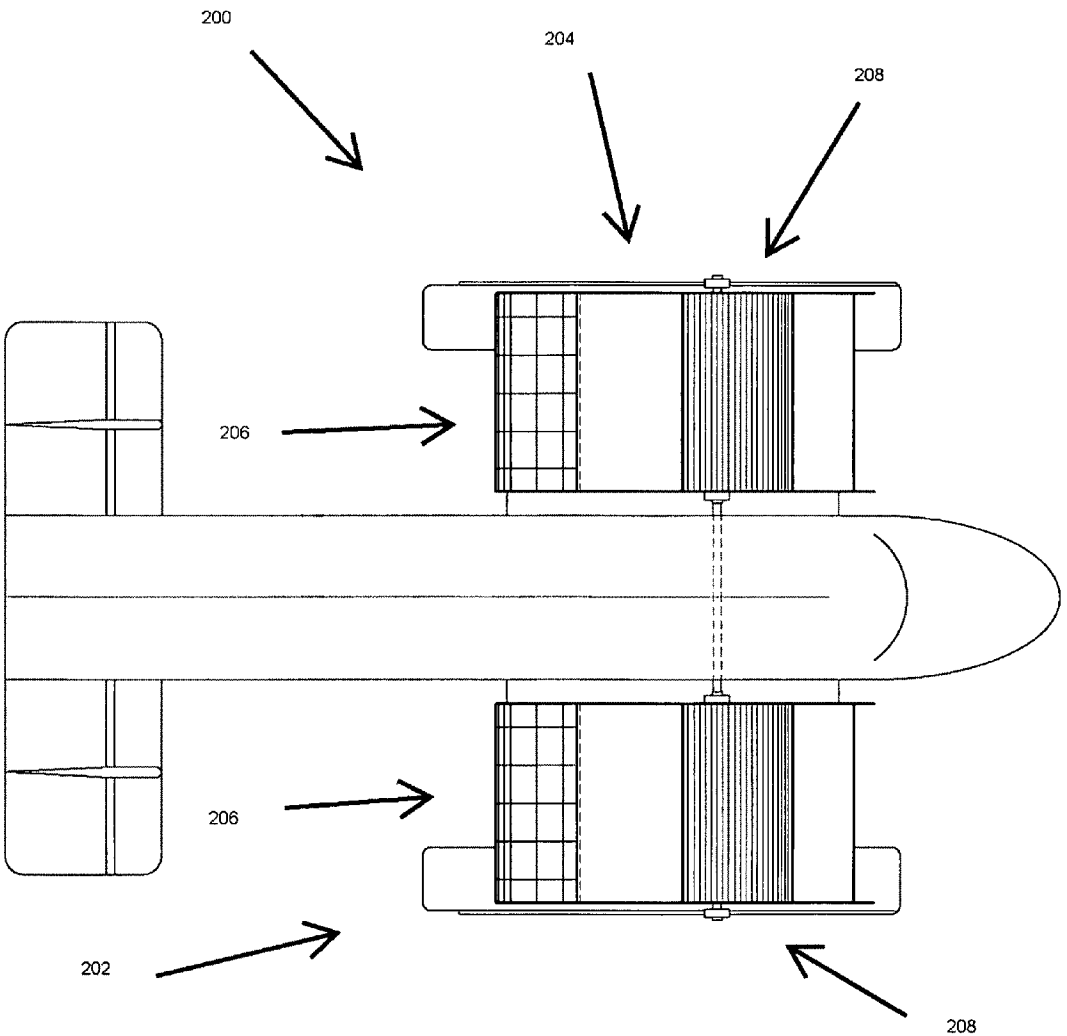
FIG. 7 is a top view of an embodiment of a vehicle in accordance with the present invention.
Figure 8:
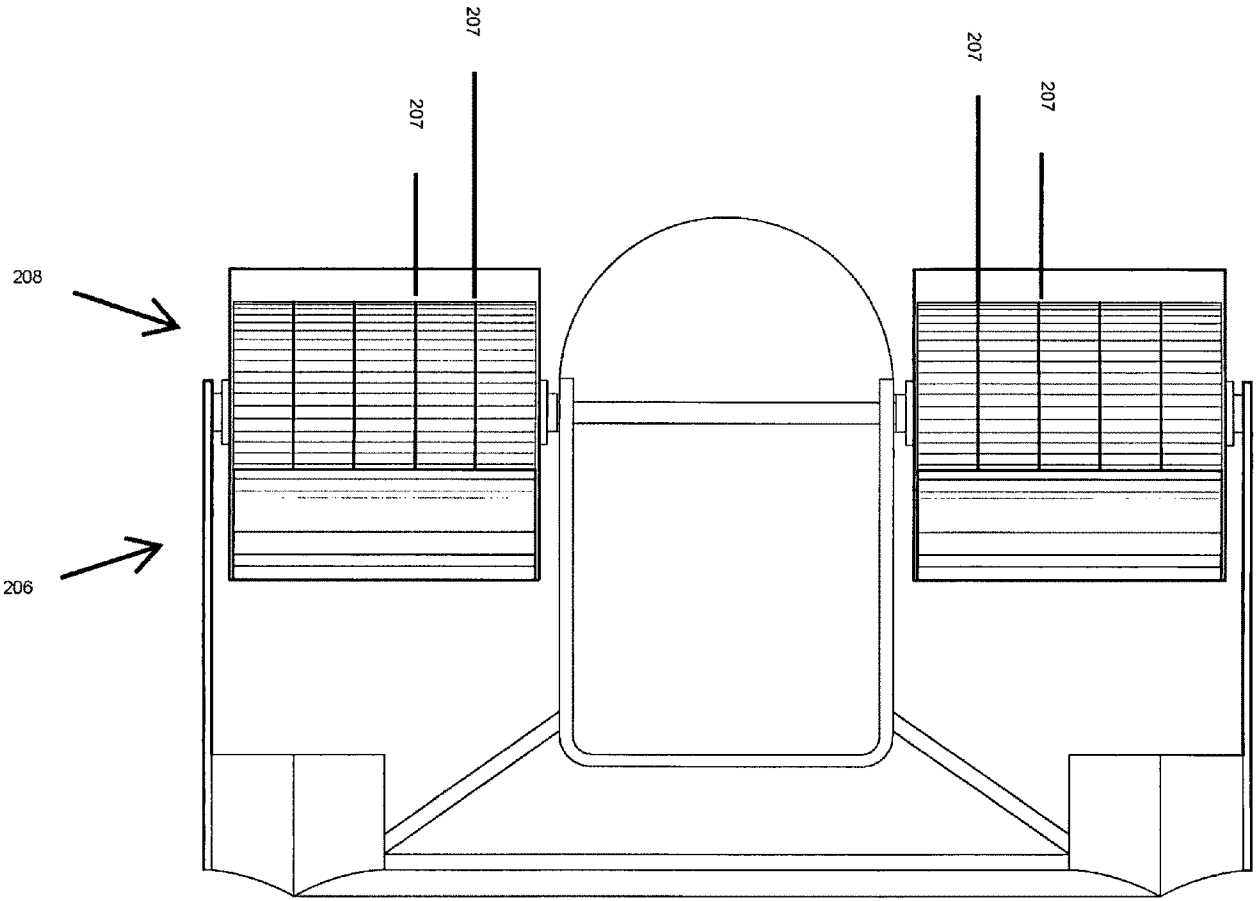
FIG. 8 is a front view of the embodiment of FIG. 7.

FIGS. 7, 8 and 9 are embodiments described as a vehicle, and in some preferred embodiments an aircraft, incorporating a propulsion apparatus and method in accordance with the present invention. The aircraft may have been designed and constructed specifically in accordance with the features of the present invention, or may be a traditional aircraft or other vehicle that is converted in accordance with the invention.

FIG. 7 depicts an aircraft 200 having propulsion apparatus 202 and 204 and describes the intake, ports and discharge as well as constant accelerating airfoils 206 and cross flow fan 208 of the present invention. The operation of the aircraft is described in FIG. 9, wherein the adjustment of the apparatus 202, 204 creates lift and thrust in adjustment of the apparatus as previously described, and allowing the adjustment for turns, banks and other maneuvers as having control provided by each of the apparatus 202, 204, and as may be further provided by traditional aeronautical features such as rudders or other such elements.

Furthermore, and as previously described, the generation of initial lift and thrust would allow for instant take-off and lift of the aircraft 200, whereas the output CFMs and movement speed can be scaled based upon the needs of the application and whereas no initial forward movement of the aircraft or propulsion apparatus is necessary in order to generate sufficient lift. In one embodiment, the manifold of the apparatus 202, 204 may be rotated in a counterclockwise direction, or in a rearward direction, so as to direct air output downwardly for the required lift. Air produced through and about the airfoils will primarily generate lift and propulsion upwardly. As the aircraft rises, the apparatus 202, 204 and fan speed may be controlled to allow the aircraft to hover, and/or may be rotated to provide for forward thrust and continuing lift to allow the aircraft to rise and move forward. As the aircraft is operated, the apparatus 202, 204 can be adjusted in flight for desired changes in flight direction, changes in altitude, wind speed and direct, desired forward flight speed, and other factors inherent in flight, while allowing for new controls not previously provided by traditional flight technology, such as the ability to hover and turn in mid-air.

Figure 16:
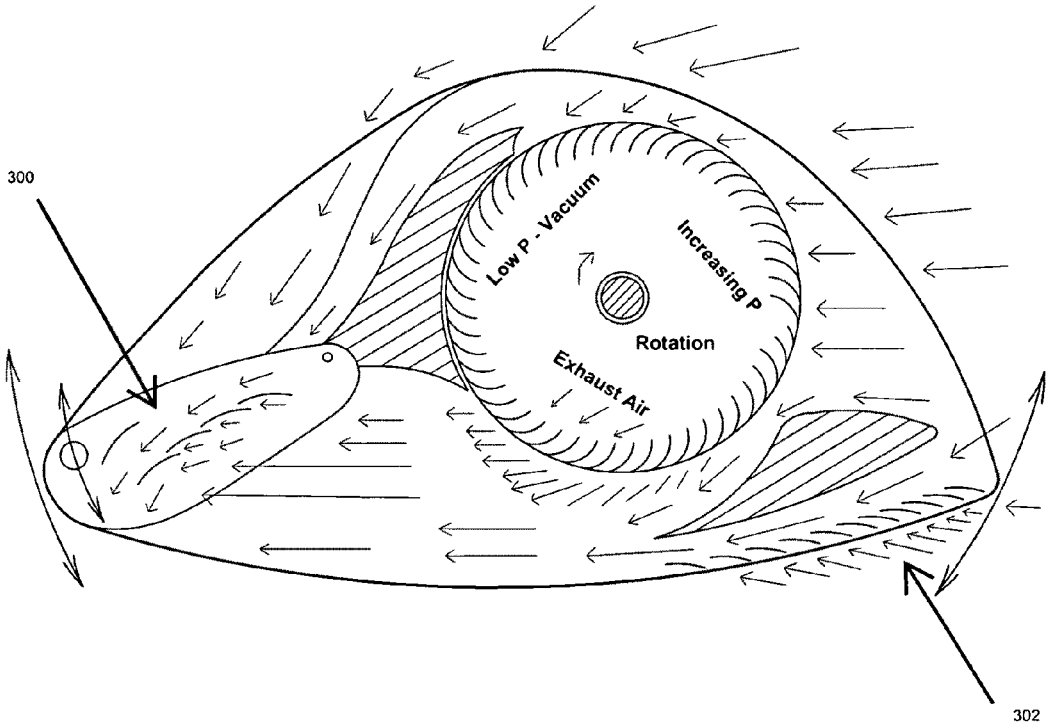
FIG. 16 is a side and partial cross-section of an embodiment of the present invention and further describing air flow, pressure, rotation and lift.
Figure 17:
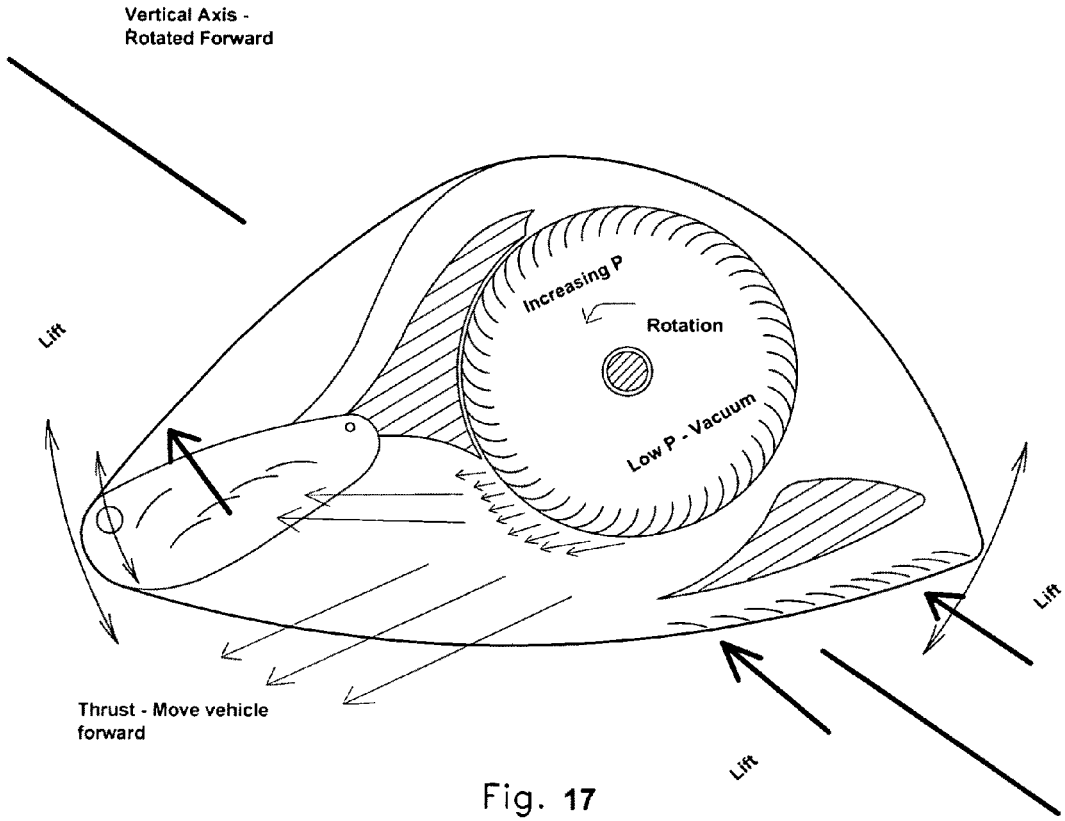
FIG. 17 is a side and partial cross-section of the embodiment of FIG. 16 in a forward rotation configuration.
Figure 18:
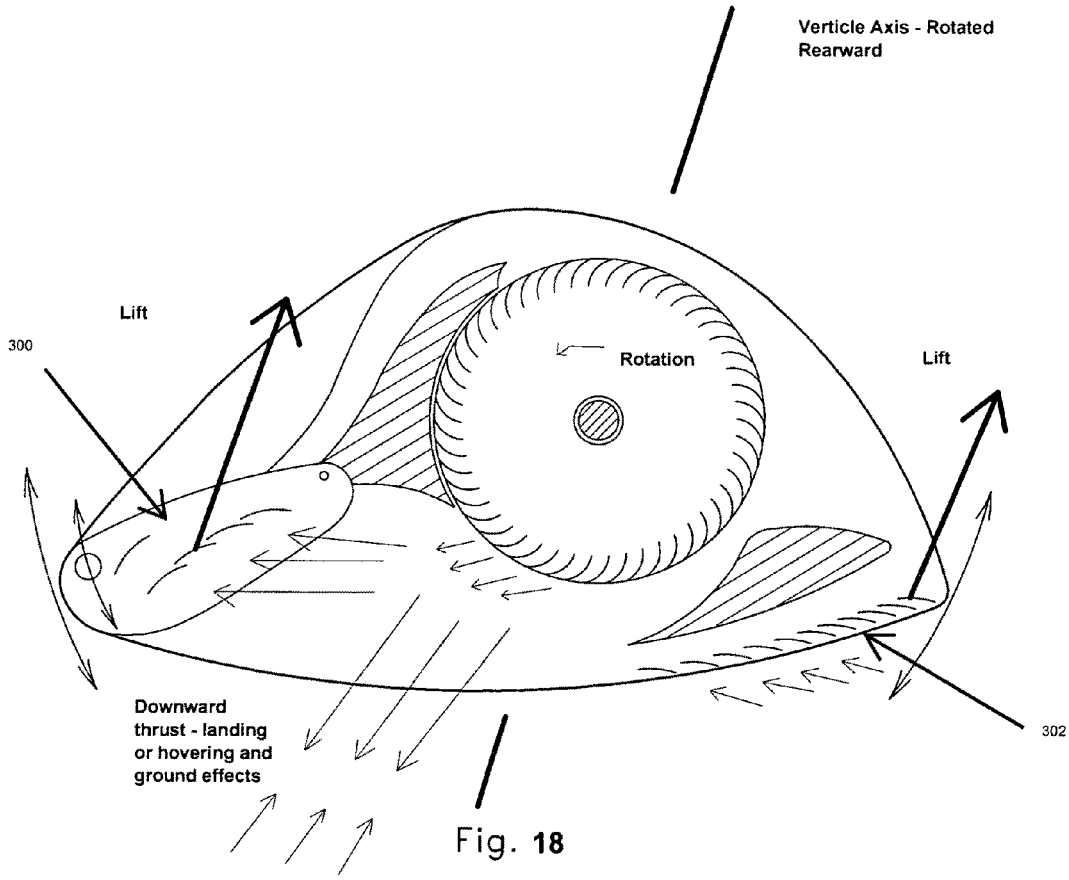
FIG. 18 is a side and partial cross-section of the embodiment of FIG. 16 in a rearward rotation configuration.

FIGS. 16, 17 and 18 help to further describe the adjustment of the vehicle propulsion apparatus and method of the present invention, such as apparatus 202 and apparatus 204 previously described. As may be shown, for example, in FIG. 16, air flow into the fan creates increasing and decreasing pressure zones and even vacuum conditions such that further rotation of the fan exhausts air to the rearward airfoils 300 while forward movement and speed of the vehicle creates airflow about the forward airfoils 302. As forward speed increases, the airfoils 302 provide lift as well as high speed air through the manifold and to airfoils 300. Airfoils 300 also receive airflow and resulting lift is created.

In still further embodiments, lift and thrust may yet be generated from air produced even when unpowered, such as in a loss of power to the fan, as by one example in a no power or stall condition. In such an application, the fan or fans 208 may be left unpowered in flight. Accordingly, air that will resultingly flow through the apparatus 202, 204 will be directed through the fan 208 and the airfoils 206 so as to continue to generated air flow and resulting lift and thrust through the control of the apparatus 202, 204. In some embodiments, the fan 208 may turn opposite to the powered configuration, as may be shown in FIGS. 17 and 18, resulting in pressure zones that still afford advantages air flow through the system, lift and thrust through the control and use of the airfoils 206, and proper control of the aircraft 200 to allow landing. In any event, as the aircraft 200 is landed, powered or unpowered, the air flow through the apparatus and about airfoils 206, and further airfoils that may be provided at the front of the apparatus as described in FIGS. 5 and 6, will allow a controlled descent and landing that further affords the opportunity, in some embodiments, to take advantage of ground-effects from air directed from the ground, allowing the aircraft 200 to comfortably land.

FIGS. 17 and 18 further describe the adjustment of the propulsion apparatus in forward and rearward rotational adjustment. Again, the adjustment forward or rearward can be provided at take-off, during flight, and in landing. FIG. 18, for example, describes both a configuration that may be used at take-off or landing, generating a maximum amount of downward thrust. In some embodiments, a rotation in this direction might be preferential for landing or hovering as well, and even in the use of and benefit from traditional ground effects. Accordingly the lift show by the arrows in the general direction of the vertical axis could correspond to a take-off, hover or landing requirement for lift. Alternatively, this configuration, or rotation in a forward or rearward direction, could result in the turning of vehicle when hovering, or even turning or banking in flight, such upward or downward lift or thrust can be accomplished for attitude adjustment. In one example, and in accordance with the embodiment of an aircraft as described in FIGS. 7 through 10, the rotation of one propulsion apparatus port in one direction and the rotation of a second propulsion apparatus starboard in another direction, as adjustable rotations, would create corresponding lift and thrust so as to change the attitude of the vehicle.

Figure 19:
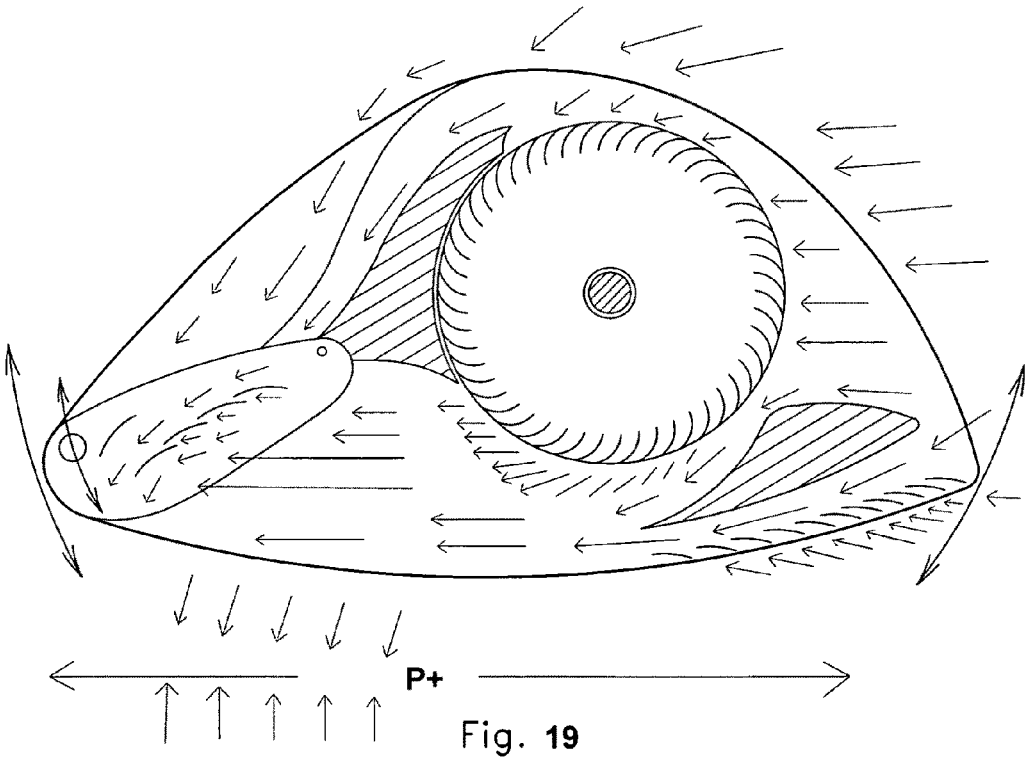
FIG. 19 is a side and partial cross-section of the embodiment of FIG. 16 further describing air flow, pressure, rotation, lift and ground effects.

The invention, and the description of FIGS. 16 through 18, is not limited of course to aircraft. In some embodiments, the vehicle may accommodate and utilize ground effects more frequently, such as a hover craft. Accordingly, FIG. 19 further describes the air flow and corresponding ground effects created when the vehicle propulsion apparatus is near ground. Of course FIG. 19 is also not limited to hover craft and may be descriptive of air flow and ground effects for any application in accordance with the present invention. Regardless of type of vehicle, the present invention incorporates and takes advantage of the cushion of air and forces created under the vehicle and the propulsion apparatus, resulting in a higher pressure P that affords the ability to hover and maneuver over the ground or other surface.

Figure 20:
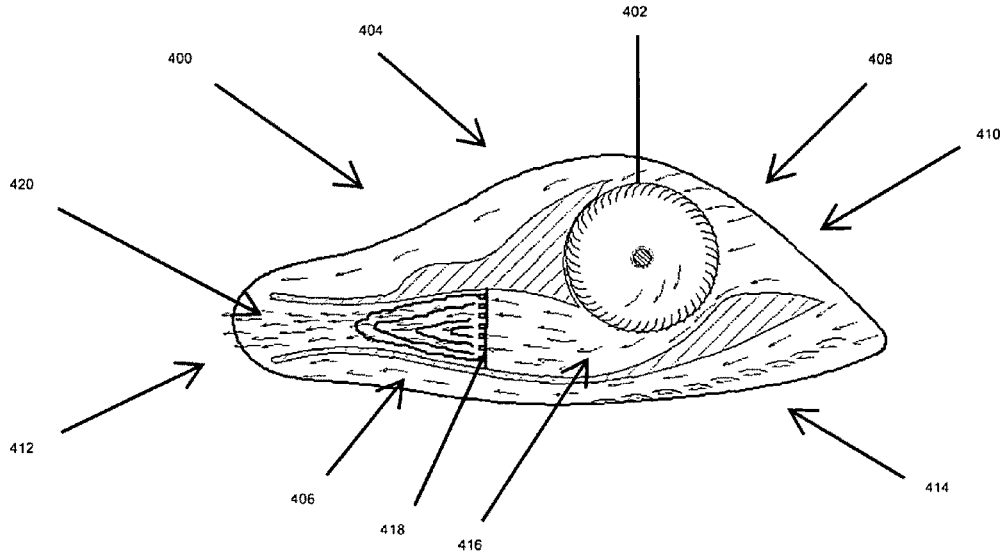
FIG. 20 is an additional embodiment of the present invention in side and partial cross-section view.
Figure 21:
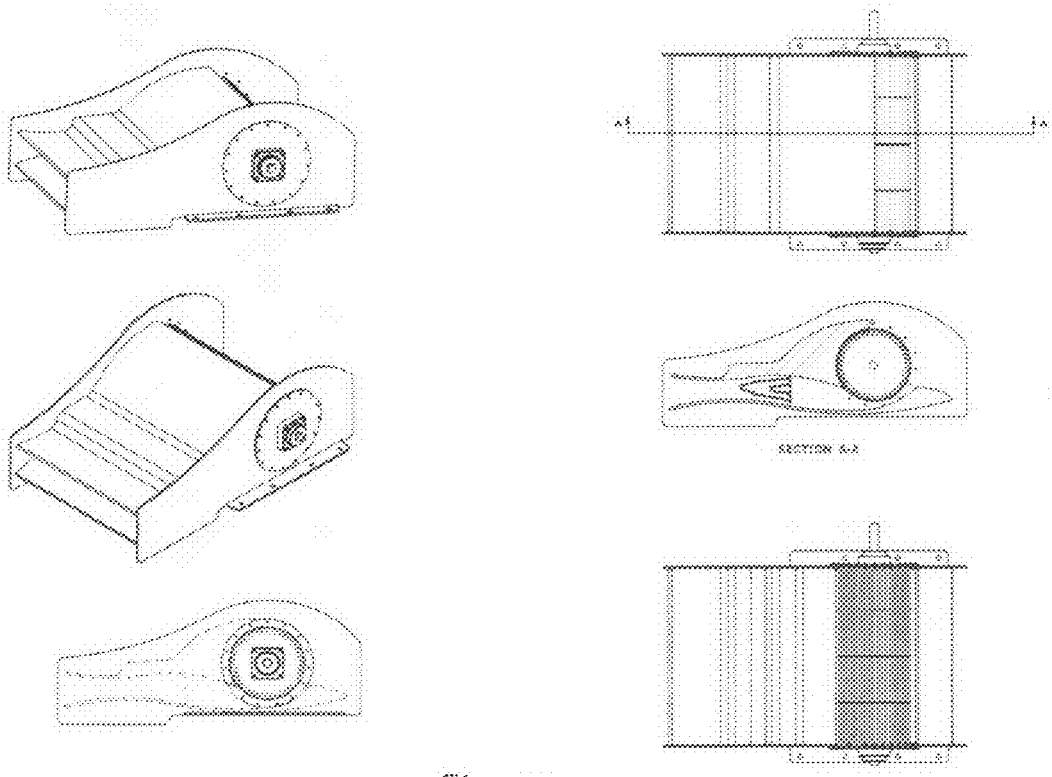
FIG. 21 describe embodiments of FIG. 20 in accordance with the present invention.

Now referring to FIGS. 20 and 21, an alternative vehicle propulsion apparatus 400 is described having a cross flow fan 402, a manifold 404 in fluid communication with the cross flow fan, a ram jet engine 406 in fluid communication with the fan, an air intake 408 having at least one port 410 in fluid communication with the fan, and a discharge 412 in fluid communication with the manifold. The operation and features of the propulsion apparatus 400 is similar in respect to the fan and airflow within the manifold generally, and in respect to the forward constant accelerating airfoils 414 that may be provided in some preferred embodiments; however, the primary thrust and lift may be generated from the ram jet engine 406 supplemented by air flow generated by the manifold. Accordingly, in some preferred embodiments, the discharge 412 provides the propulsion of the apparatus 400 from the air from the manifold and the thrust generated from the ram jet engine.

In accordance with previous embodiments, the manifold may be adjustably rotated in order to adjust lift, thrust, propulsion, and results in control of lift, thrust and propulsion, as well as overall preferred multi-dimensional flight control and low speed or even hover control, turning, and banking from the thrust of the ram jet engine and air produced from the fan.

The operation and features incorporate the operation and features of the fan driven embodiments previously described. However, the incorporation of the ram jet engine may afford lift and thrust not previously considered obtainable in any such driven air design traditionally known, and may even afford vehicle speeds beyond those obtainable in previously described embodiments.

The ram jet engine itself in some preferred embodiments may be of a traditional ram jet engine design, incorporating a combustion chamber and fuel burners, as shown in FIGS. 20 and 21, but may further include other elements such as diffuser and nozzle elements, air intake and discharge, such as a propelling nozzle or even of a venturi design. Modifications to the traditional ram jet in accordance with the present invention would provide a ram jet configuration, and in some embodiments a combustion chamber, air intake, burners and discharge that accommodate for the configuration and extent of the manifold and cross flow fan. Other embodiments of the invention may comprise other jet designs.

Accordingly, and again in reference to FIGS. 20 and 21, an air intake 416 and fuel burners 418 are shown, wherein air intake may be modified in some embodiments to accommodate the full and preferred air flow generated by the fan. Furthermore, discharge 412 may be reference to the discharge of the manifold as well as, or including a separate discharge 420 for the jet engine. The air intake, discharge and other aspects of the ram jet engine are shown configured in FIG. 21. FIG. 21 describe the ram jet engine as being modified to extend the full intake and discharge of the propulsion apparatus that at its extents may be defined by the ends of the manifold. Accordingly, the ram jet engine may take on an elongated form in its width, and in some embodiments be of a general rectangular or similar shape to accommodate for and to take full advantage of the air produced from the cross flow fan and manifold. FIGS. 20 and 21 are but one example of the modification to a ram jet engine consistent with the present invention. Further, and in light of the scalability of the invention, the increased width of the ram jet engine may afford even greater thrust created by the ram jet engine.

The invention in all its features previously described is scalable to accommodate preferred lift and thrust as previously described, producing lift and thrust corresponding to determined lift and thrust requirements. Whereas some traditional systems may be understood as one-dimension in flight control, limiting application and generally producing only thrust, the present invention, incorporating a modified cross flow fan configuration in preferred embodiments, provides a highly efficient, low-drag design, particularly in its constant accelerating design, having a high-lift multi-airfoil technology.

The invention accomplishes the efficient and low-drag design through constant accelerating airfoil features that may eliminate circulation and produce strong boundary layer control, particularly when provided in some embodiments as a plurality of airfoils.

As can be easily understood from the foregoing, the basic concepts of the present invention may be embodied in a variety of ways. It involves techniques as well as one or more apparatus, device and assembly, as well as devices, assemblages and several apparatus that may provide for the appropriate techniques. In this application, the techniques of the present invention in some embodiments are disclosed as part of the results shown to be achieved by the various devices, assemblages and several apparatus described and as steps that are inherent to utilization. They are simply the natural result of utilizing the devices, assemblages or several apparatus as intended and described. In addition, while some devices and apparatus are disclosed, it should be understood that these not only accomplish certain methods but also can be varied in a number of ways. Importantly, as to all of the foregoing, all of these embodiments are encompassed by this disclosure.

Further, each of the various elements or steps of the invention may also be achieved in a variety of manners. This disclosure should be understood to encompass each such variation, be it a variation of an apparatus embodiment, a method or process embodiment, or even merely a variation of any element of these. Particularly, it should be understood that as the disclosure relates to specific features of the invention, the words for each feature may be expressed by equivalent apparatus, device, assembly or method terms—even if only the function or result is the same. Such equivalent, broader, or even more generic terms should be considered to be disclosed for each element, step, or action. Such terms can be substituted where desired to make explicit the implicitly broad coverage to which this invention is entitled. As but one example, it should be understood that all actions or functions may be expressed as a means for taking that action or achieving that function, or as an element which causes that action or has that function. Similarly, each physical element disclosed should be understood to encompass a disclosure of the action or function which is facilitated by that physical element.

Any acts of law, statutes, regulations, or rules mentioned in this application for patent; or any patents, publications, or other references mentioned in this application for patent are hereby incorporated by reference. In addition, as to each term used it should be understood that unless its utilization in this application is inconsistent with such interpretation as would be understood by one of ordinary skill in the art from this disclosure, common dictionary definitions should be understood as incorporated for each term and all definitions, alternative terms, and synonyms such as contained in the Random House Webster's Unabridged Dictionary, second edition are hereby incorporated by reference. However, as to each of the above, to the extent that such references, information or statements incorporated by reference might be considered inconsistent with the patenting of the invention, such as contradicting disclosed features ascertained by a reading of these patent documents, such information and statements are expressly not to be considered incorporated by reference and more particularly as not made by the Applicant. Furthermore, as to any dictionary definition or other extrinsic evidence utilized to construe this disclosure, if more than one definition is consistent with the use of the words in the intrinsic record, the claim terms should be construed to encompass all such consistent meanings.

Furthermore, if or when used, the use of the transitional phrase "comprising" is used to maintain "open-end" disclosure herein, according to traditional disclosure and claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

We claim:

1. A vehicle propulsion apparatus, comprising: a cross flow fan;

a manifold in fluid communication with said cross flow fan; an air intake having at least one port in fluid communication with said cross flow fan; and an air discharge in fluid communication with said cross flow fan; wherein said air discharge provides propulsion from air from said cross flow fan and wherein said manifold controls lift and thrust from air from said cross flow fan.

2. A vehicle propulsion apparatus as described in claim 1, wherein said cross flow fan comprises a plurality of constant accelerating airfoils.

3. A vehicle propulsion apparatus as described in claim 1, wherein said manifold is rotatable about a central axis of said cross flow fan.

4. A vehicle propulsion apparatus as described in claim 1, wherein said manifold is rotatably adjustable to control lift and thrust from air from said cross flow fan.

5. A vehicle propulsion apparatus as described in claim 1, wherein said air discharge comprises a plurality of constant accelerating airfoils providing lift from air from said cross flow fan.

6. A vehicle propulsion apparatus as described in claim 5, wherein said plurality of constant accelerating airfoils of said air discharge provide boundary layer airflow about said plurality of constant accelerating airfoils.

7. A vehicle propulsion apparatus as described in claim 6, wherein said plurality of constant accelerating airfoils of said air discharge minimize drag corresponding to boundary layer airflow about said plurality of constant accelerating airfoils.

8. A vehicle propulsion apparatus as described in claim 5, wherein said plurality of constant accelerating airfoils of said air discharge provide lift corresponding to an orientation of said manifold.

9. A vehicle propulsion apparatus as described in claim 8, wherein said manifold is rotatably adjustable to control lift from said constant accelerating airfoils.

10. A vehicle propulsion apparatus as described in claim 1, wherein said manifold is rotatably adjustable to control thrust produced from said air discharge.

11. A vehicle propulsion apparatus as described in claim 5, wherein said cross flow fan produces air unpowered and wherein said plurality of constant accelerating airfoils of said air discharge provide lift corresponding to an orientation of said manifold.

12. A vehicle propulsion apparatus as described in claim 1, further comprising a companion air intake in fluid communication with said cross flow fan.

13. A vehicle propulsion apparatus as described in claim 12, wherein said companion air intake comprises a plurality of constant accelerating airfoils providing companion air to air produced from said cross flow fan.

14. A vehicle propulsion apparatus as described in claim 13, wherein said plurality of constant accelerating airfoils of said companion air intake provide lift corresponding to an orientation of said manifold.

15. A vehicle propulsion apparatus as described in claim 1, wherein said manifold reduces circulation air flow about an axial extent of said cross flow fan.

16. A vehicle propulsion apparatus as described in claim 1, further comprising a jet engine in fluid communication with said air discharge.

17. A vehicle propulsion apparatus as described in claim 16, wherein said jet engine provides propulsion from air from said air discharge.

18. A vehicle propulsion apparatus, comprising: a cross flow fan; a manifold rotatably adjustable to provide lift and thrust from air from said cross flow fan; and a plurality of airfoils providing lift from air from said cross flow fan.

19. A vehicle propulsion apparatus as described in claim 18, wherein said plurality of airfoils provide boundary layer airflow about said plurality airfoils.

20. A vehicle propulsion apparatus as described in claim 18, wherein said plurality of airfoils comprise constant accelerating airfoils.

21. A vehicle propulsion apparatus as described in claim 20, wherein said plurality of constant accelerating airfoils minimize drag corresponding to boundary layer airflow about said plurality of constant accelerating airfoils.

22. A vehicle propulsion apparatus as described in claim 20, wherein said plurality of constant accelerating airfoils provide lift corresponding to an orientation of said manifold.

23. A vehicle propulsion apparatus as described in claim 20, wherein said manifold is rotatably adjustable to control lift from said constant accelerating airfoils.

24. A vehicle propulsion apparatus as described in claim 20, wherein said cross flow fan is configured to produce air unpowered and wherein said plurality of constant accelerating airfoils provide lift corresponding to an orientation of said manifold.

25. A vehicle propulsion apparatus as described in claim 18, further comprising a jet engine in fluid communication with said air discharge.

26. A vehicle propulsion apparatus as described in claim 25, wherein said jet engine provides propulsion from air from said air discharge.

27. A method of propulsion, comprising: intaking air through an air intake having at least one port in fluid communication with said cross flow fan; directing air from a cross flow fan through a manifold; providing lift by a plurality of airfoils of said manifold acted upon by said air from said cross flow fan; discharging air from an air discharge in fluid communication with said cross flow fan; providing propulsion from said air from said cross flow fan discharged through said air discharge; and adjusting said manifold to control lift and thrust from said air from said cross flow fan.

28. A method of propulsion as described in claim 27, wherein providing lift comprises providing lift by a plurality of constant accelerating airfoils.

29. A method of propulsion as described in claim 28, wherein controlling lift comprises controlling lift by a plurality of constant accelerating airfoils.

30. A method of propulsion as described in claim 27, wherein adjusting comprises rotatably adjusting said manifold.

31. A method of propulsion as described in claim 30, wherein rotatably adjusting comprises rotatably adjusting said manifold about an axis of said cross flow fan.

32. A method of propulsion as described in claim 27, wherein adjusting comprises adjusting a plurality of constant accelerating airfoils.

33. A method of propulsion as described in claim 27, wherein directing air comprises producing air from said cross flow fan unpowered and wherein providing lift comprises providing lift by adjusting said manifold.

34. A method of propulsion as described in claim 27, further comprising: providing companion air from a companion air intake; and providing lift from a plurality of constant accelerating airfoils of said companion air intake.

35. A method of propulsion as described in claim 27, further comprising: directing air from an air discharge to a ram jet engine; and providing propulsion by said ram jet engine from air directed from said air discharge.

36. A vehicle propulsion apparatus, comprising: a cross flow fan; a manifold in fluid communication with said cross flow fan; a ram jet engine in fluid communication with said cross flow fan; an air intake having at least one port in fluid communication with said cross flow fan; and a discharge in fluid communication with said manifold; wherein said discharge provides propulsion from air from said manifold and from said ram jet engine and wherein said manifold controls lift and thrust from said ram jet engine.

* * * * *